US008581506B2

(12) United States Patent
Yamauchi et al.

(10) Patent No.: US 8,581,506 B2
(45) Date of Patent: Nov. 12, 2013

(54) DISCHARGE LAMP DRIVING DEVICE AND METHOD, LIGHT SOURCE DEVICE, AND IMAGE DISPLAYING APPARATUS

(75) Inventors: Kentaro Yamauchi, Ashiya (JP); Tetsuo Terashima, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1073 days.

(21) Appl. No.: 12/573,258

(22) Filed: Oct. 5, 2009

(65) Prior Publication Data

US 2010/0084987 A1 Apr. 8, 2010

(30) Foreign Application Priority Data

Oct. 7, 2008 (JP) ..... 2008-260195
Jul. 21, 2009 (JP) ..... 2009-170245

(51) Int. Cl.

| | |
|---|---|
| ***H05B 37/00*** | (2006.01) |
| ***H05B 39/04*** | (2006.01) |
| ***H05B 41/36*** | (2006.01) |
| ***H05B 37/02*** | (2006.01) |
| ***H05B 39/02*** | (2006.01) |
| ***H05B 39/00*** | (2006.01) |
| ***H05B 41/16*** | (2006.01) |
| ***H05B 41/24*** | (2006.01) |
| ***H05B 41/00*** | (2006.01) |
| ***H01J 13/48*** | (2006.01) |
| ***H01J 15/04*** | (2006.01) |
| ***H01J 17/36*** | (2006.01) |

(52) U.S. Cl.
USPC ..... 315/224; 315/209 R; 315/246; 315/291; 315/326

(58) Field of Classification Search
None
See application file for complete search history.

(56) References Cited

U.S. PATENT DOCUMENTS 6,979,960 B2 12/2005 Okawa et al.
2010/0033692 A1 * 2/2010 Watanabe et al. ..... 353/85

FOREIGN PATENT DOCUMENTS

| | | | |
|---|---|---|---|
| JP | 2004-207018 | A | 7/2004 |
| JP | 2004-525496 | T | 8/2004 |
| JP | 2004-342465 | A | 12/2004 |
| JP | 2005-100787 | A | 4/2005 |
| WO | WO-02-091806 | A | 11/2002 |

* cited by examiner

*Primary Examiner* — Douglas W Owens
*Assistant Examiner* — Dedei K Hammond
(74) *Attorney, Agent, or Firm* — ALG Intellectual Property, LLC

(57) ABSTRACT

In at least one embodiment of the disclosure, a discharge lamp driving device includes a discharge lamp lighting unit configured to supply power to a discharge lamp while alternately switching a polarity of a voltage applied across two electrodes of the discharge lamp. A controller performs a modulation control of the power in accordance with a power ratio characterized by the power supplied in a polarity switching period. The controller starts the modulation control at a predetermined time after the power supplied to the discharge lamp reaches a predetermined power value.

18 Claims, 25 Drawing Sheets

FIG. 8A DUTY RATIO IS NOT MODULATED
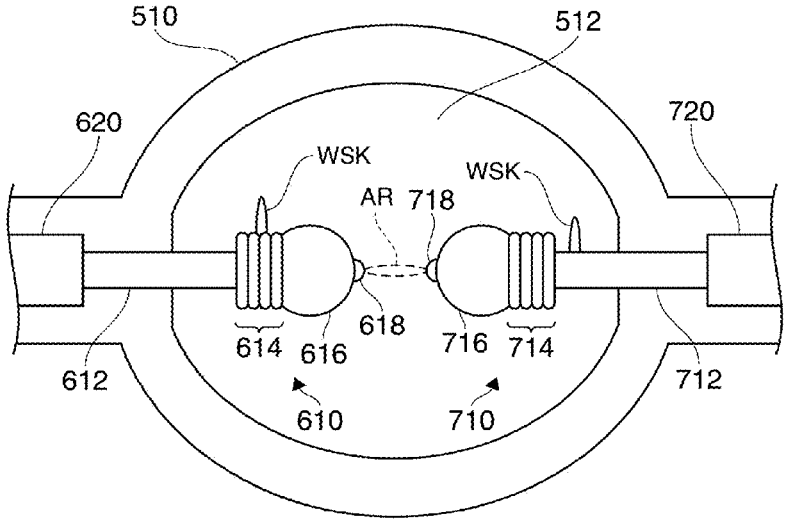
FIG. 8B DUTY RATIO IS MODULATED
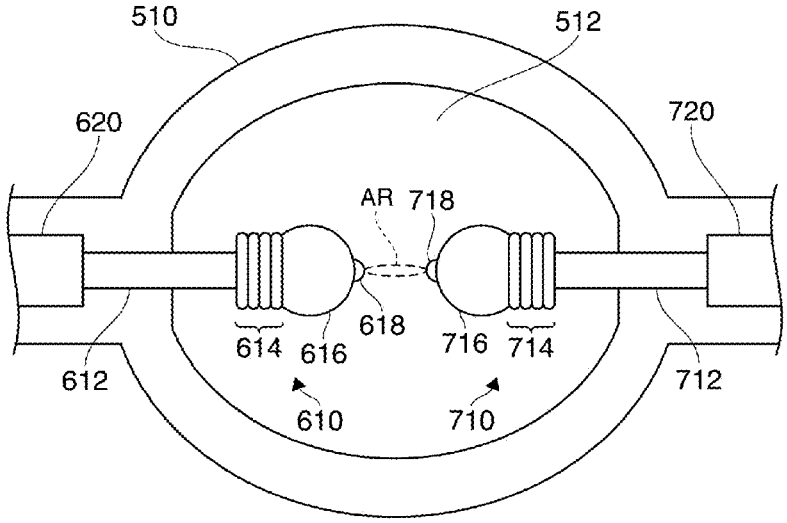

INITIAL START STAGE

AFTER STARTING DUTY RATIO MODULATION CONTROL
(WHEN ELECTRODE 610 IS POSITIVE ELECTRODE)

AFTER STARTING DUTY RATIO MODULATION CONTROL
(WHEN ELECTRODE 610 IS NEGATIVE ELECTRODE)

DISCHARGE LAMP DRIVING DEVICE AND METHOD, LIGHT SOURCE DEVICE, AND IMAGE DISPLAYING APPARATUS

CROSS-REFERENCE

The present application claims priority from Japanese Patent Application No. 2008-260195 filed on Oct. 7, 2008 and Japanese Patent Application No. 2009-170245 filed on Jul. 21, 2009, each of which is hereby incorporated by reference in its entirety.

BACKGROUND

A high-brightness discharge lamp such as a high-pressure gas discharge lamp may be used as a light source in an image displaying apparatus such as a projector. To operate the high-brightness discharge lamp, an AC current is supplied to the high-brightness discharge lamp. When the AC current is supplied to allow the high-brightness discharge lamp to light up, in order to suppress the movement of an arc start point or the variation in arc length and to improve the stability of the light arc, it is taught that the absolute value of the AC current supplied to the high-brightness discharge lamp is almost constant and the pulse width ratio of a pulse width of a positive pulse and a pulse width of a negative pulse is modulated (for example, see JP-T-2004-525496).

However, when an AC current whose pulse width ratio is modulated is supplied to the high-brightness discharge lamp, there are problems with the electrodes being excessively melted. These problems are not limited to the high-brightness discharge lamp modulating the pulse width ratio of the AC current, but are common to high-brightness discharge lamps in which the ratio of the power in a positive-electrode period in which one electrode operates as a positive electrode and the power in a negative-electrode period in which the one electrode operates as a negative electrode in one period of the AC current supplied to the high-brightness discharge lamp. These problems are not limited to the high-brightness discharge lamp, but are common to various discharge lamps emitting light by arc discharge between electrodes.

SUMMARY

Various embodiments of the disclosure provide techniques of stopping electrodes from being excessively melted when an AC current is supplied to a discharge lamp.

In certain embodiments a discharge lamp driving device includes a discharge lamp lighting unit allowing the discharge lamp to light up by supplying power to the discharge lamp while alternately switching the polarity of a voltage applied across two electrodes of the discharge lamp; and a controller controlling the discharge lamp lighting unit to supply the power while changing the ratio of the power supplied in a positive-electrode period in which one of the electrodes operates as a positive electrode and the power supplied in a negative-electrode period in which the other of the electrodes operates as a negative electrode in one polarity switching period in which the polarity of the voltage applied across the two electrodes is alternately switched as a power ratio change control. Here, the controller starts the power ratio change control in a predetermined time after the power supplied to the discharge lamp reaches a predetermined power value.

According to this discharge lamp driving device, since the power ratio change control is started in a predetermined time after the power supplied to the discharge lamp reaches a predetermined power value, the power ratio change control is started after the voltage across the electrodes and the current supplied to the discharge lamp are stabilized. Therefore, since the power whose power ratio is 50% or more is stopped from being supplied to the electrodes when the current is high, it is possible to suppress the electrodes from being excessively melted.

In certain embodiments, the controller changes the power ratio by changing the ratio of the time of the positive-electrode period and the time of the negative-electrode period in one polarity switching period as the power ratio change control.

According to this discharge lamp driving device, it is possible to more easily change the power ratio by changing the ratio of the time of the positive-electrode period and the time of the negative-electrode period in one polarity switching period.

In certain embodiments, the controller changes the power ratio by changing the difference in absolute value between the current supplied in the positive-electrode period and the current supplied in the negative-electrode period in one polarity switching period as the power ratio change control.

According to this discharge lamp driving device, it is possible to more easily change the power ratio by changing the difference between the value of the current supplied in the positive-electrode period and the absolute value of the current supplied in the negative-electrode period in one polarity switching period.

According to at least one previously described embodiment, the controller controls the discharge lamp lighting unit to supply the power while changing the ratio of the power supplied in the positive-electrode period and the power supplied in the negative-electrode period as a preliminary power ratio change control until the power ratio change control is started after the power supplied to the discharge lamp reaches the predetermined power value. Here, the maximum of the power in the positive-electrode period in the preliminary power ratio change control may be smaller than the maximum of the power in the positive-electrode period in the power ratio change control.

According to this discharge lamp driving device, the maximum of the power in the positive-electrode period in the preliminary power ratio change control is smaller than the maximum of the power in the positive-electrode period in the power ratio change control. Accordingly, even when the power supplied to the discharge lamp reaches a predetermined power value, it is possible to suppress a larger amount of power from being supplied to the electrodes until a predetermined time passes in the power ratio change control. Therefore, it is possible to suppress the electrodes from being excessively melted.

Accordingly to at least one previously described embodiment, the predetermined time is determined on the basis of at least one of the value of the voltage applied across the two electrodes and the value of the current supplied to the discharge lamp.

According to this discharge lamp driving device, since the predetermined time is determined on the basis of at least one of the value of the voltage applied across the two electrodes and the value of the current supplied to the discharge lamp, a proper time can be determined for each discharge lamp or a proper time can be determined depending on the deterioration of the discharge lamp or the like.

Accordingly to at least one previously described embodiment, the predetermined power value may be a first power value. In this case, when controlling the discharge lamp lighting unit so that the power supplied to the discharge lamp has a second power value lower than the first power value on the basis of a power control instruction input from the outside, the controller may lower the power to the second power value after the power is raised to the first power value and is stabilized in the first power value.

According to this discharge lamp driving device, when the power supplied to the discharge lamp is controlled to the second power value, the power is first controlled to the first power value higher than the second power value. Accordingly, the temperature of the discharge lamp can be raised more rapidly, thereby reducing the time required to raise the brightness of the discharge lamp to a desired brightness.

In certain embodiments, a discharge lamp driving device includes a discharge lamp lighting unit allowing the discharge lamp to light up by supplying power to the discharge lamp while alternately switching the polarity of a voltage applied across two electrodes of the discharge lamp; and a controller controlling the discharge lamp lighting unit to supply the power while changing the ratio of the power supplied in a positive-electrode period in which one of the electrodes operates as a positive electrode and the power supplied in a negative-electrode period in which the other of the electrodes operates as a negative electrode in one polarity switching period in which the polarity of the voltage applied across the two electrodes is alternately switched as a power ratio change control. Here, the controller starts the power ratio change control after a wait time, which is determined on the basis of an electrical behavior of the discharge lamp, after the power supplied to the discharge lamp reaches a predetermined power value.

According to this discharge lamp driving device, the power ratio change control is started in the wait time after the power supplied to the discharge lamp reaches a predetermined power value and the wait time is determined on the basis of the electrical behavior of the discharge lamp. Accordingly, the power ratio change control is started after the voltage across the electrodes and the current supplied to the discharge lamp are stabilized. Therefore, since the power is stopped from being excessively supplied to the electrodes, it is possible to suppress the electrodes from being excessively melted.

Accordingly to at least one previously described embodiment, the wait time is a period of time until the current supplied to the discharge lamp is lowered to a predetermined current value.

According to this discharge lamp driving device, the power ratio change control is started after the current supplied to the discharge lamp is lowered to a predetermined current value. Therefore, by setting the predetermined current value to such a value that the electrodes are not excessively melted in spite of performing the power ratio change control, it is possible to suppress the electrodes from being excessively melted.

Accordingly to at least one previously described embodiment, the wait time may be a period of time until the voltage applied to the discharge lamp is raised to a predetermined voltage value.

According to this discharge lamp driving device, the power ratio change control is started after the voltage supplied to the discharge lamp is raised to a predetermined voltage value. Therefore, by setting the predetermined voltage value to such a value that the electrodes are not excessively melted in spite of performing the power ratio change control, it is possible to suppress the electrodes from being excessively melted.

The embodiments may be embodied in various aspects. For example, embodiments may be embodied in aspects such as a discharge lamp driving device, a discharge lamp driving method, a light source device using a discharge lamp, a control method of the light source device, and an image displaying apparatus using the light source device.

BRIEF DESCRIPTION OF THE DRAWINGS

Non-limiting and non-exhaustive embodiments of the present disclosure will be described with reference to the accompanying drawings, wherein like numbers reference like elements.

FIGS. 8A and 8B are diagrams schematically illustrating the influence of the duty ratio modulation on electrodes.

DESCRIPTION OF EMBODIMENTS

In the following description, reference is made to the accompanying drawings which form a part hereof, and in which are shown, by way of illustration, specific embodiments in which the disclosure may be practiced. It is to be understood that other embodiments may be utilized and changes may be made without departing from the scope of the present disclosure. Therefore, the following detailed description is not to be taken in a limiting sense, and the scope of the present disclosure is defined by the appended claims and their equivalents.

Throughout the specification and claims, the following terms take at least the meanings explicitly associated herein, unless the context clearly dictates otherwise. The meanings identified below are not intended to limit the terms, but merely provide illustrative examples for use of the terms. The meaning of "a," "an," "one," and "the" may include reference to both the singular and the plural. Reference in the specification to "one embodiment" or "an embodiment" means that a particular feature, structure, or characteristic described in connection with the embodiment may be included in at least one embodiment of the disclosure. The appearances of the phrases "in one embodiment" or "in an embodiment" in various places in the specification do not necessarily all refer to the same embodiment, but it may. Several embodiments will sequentially be described under corresponding section headings below. Section headings are merely employed to improve readability, and they are not to be construed to restrict or narrow the present disclosure. For example, the order of description headings should not necessarily be construed so as to imply that these operations are necessarily order dependent or to imply the relative importance of an embodiment. Moreover, the scope of a disclosure under one section heading should not be construed to restrict or to limit the disclosure to that particular embodiment, rather the disclosure should indicate that a particular feature, structure, or characteristic described in connection with a section heading is included in at least one embodiment of the disclosure, but it may also be used in connection with other embodiments.

A. First Embodiment

A-1. Configuration

Figure 1:
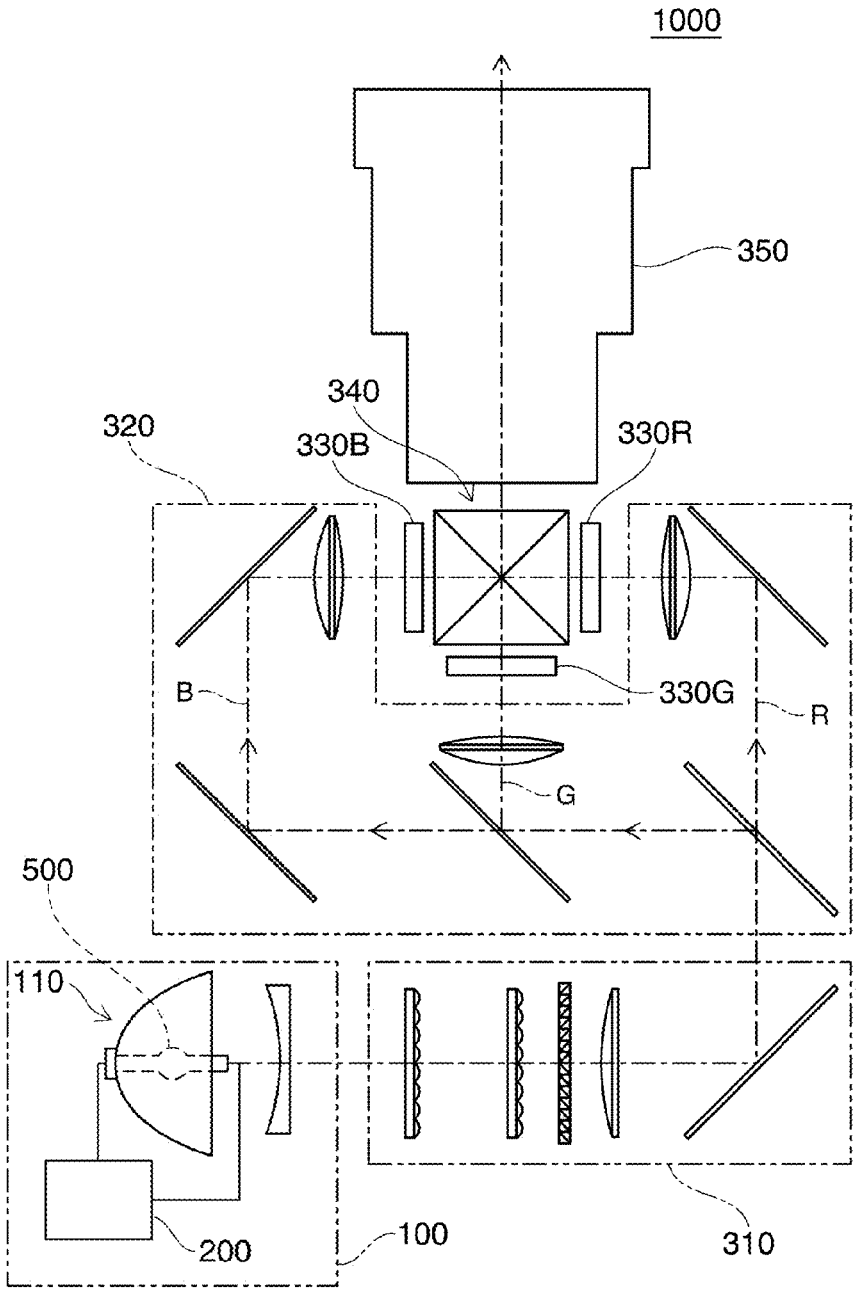
FIG. 1 is a diagram schematically illustrating the configuration of a projector according to at least one embodiment.

FIG. 1 is a diagram schematically illustrating a projector 1000 according to a first embodiment. The projector 1000 includes a light source device 100, an illuminating optical system 310, a color-separating optical system 320, three liquid crystal light valves 330R, 330G, and 330B, a cross dichroic prism 340, and a projecting optical system 350.

The light source device 100 includes a light source unit 110 mounted with a discharge lamp 500 and a discharge lamp driving device 200 driving the discharge lamp 500. The discharge lamp 500 discharges with the supply of power from the discharge lamp driving device 200 and emits light. The light source unit 110 emits the light from the discharge lamp 500 to the illuminating optical system 310. The specific configurations and functions of the light source unit 110 and the discharge lamp driving device 200 will be described later.

The light emitted from the light source unit 110 is made to be uniform in illumination intensity on the liquid crystal light valves 300R, 300G, and 300B by the illuminating optical system 310 and the polarization direction thereof is arranged in one direction. The light passing through the illuminating optical system 310 is separated into three color light components of red (R), green (G), and blue (B) by the color-separating optical system 320. The three color light components separated by the color-separating optical system 320 are modulated by the corresponding liquid crystal light valves 330R, 330G, and 330B, respectively. The three color light components modulated by the liquid crystal light valves 330R, 330G, and 330B are combined by the cross dichroic prism 340 and are input to the projecting optical system 350. By allowing the projecting optical system 350 to project the input light onto a screen not shown, an image as a full color image which is obtained by combining the images modulated by the liquid crystal light valves 330R, 330G, and 330B is displayed on the screen. In the first embodiment, three color light components are individually modulated by three liquid crystal light valves 330R, 330G, and 330B, but the color light components may be modulated by one liquid crystal light valve having a color filter. In this case, the color-separating optical system 320 and the cross dichroic prism 340 can be omitted.

Figure 2:
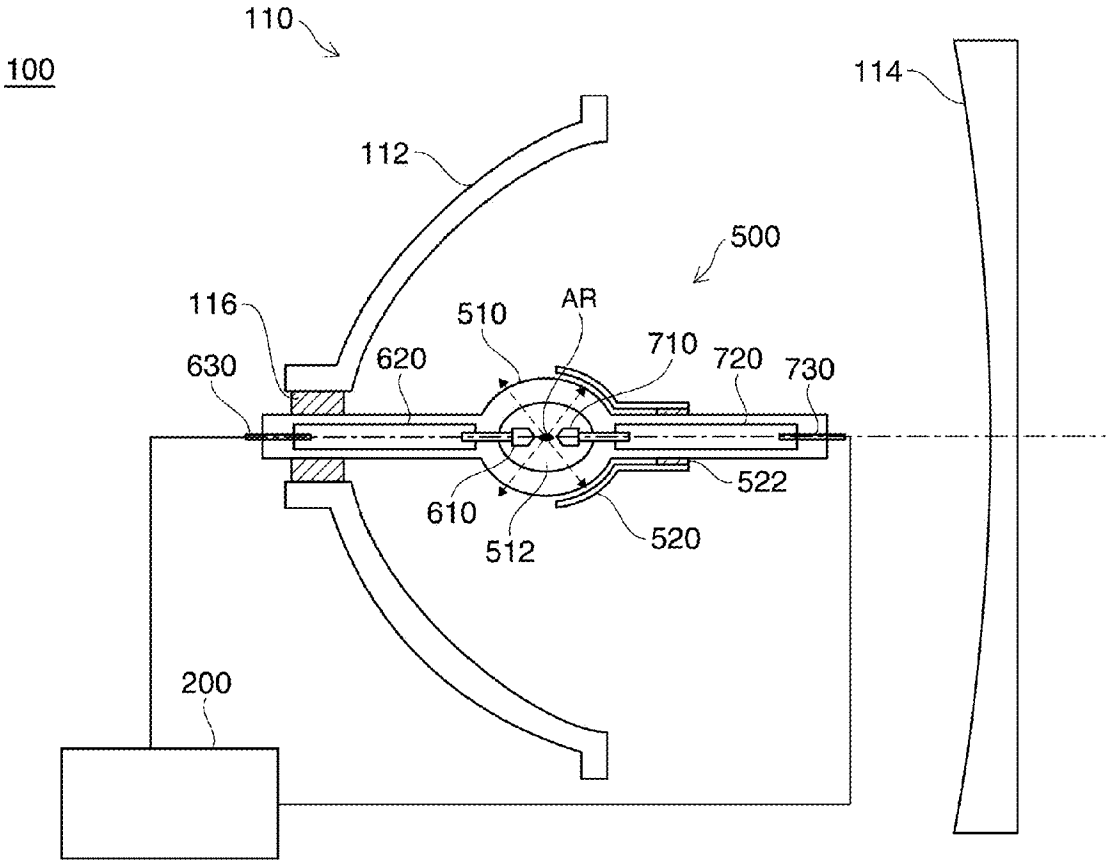
FIG. 2 is a diagram illustrating the configuration of a light source device.

FIG. 2 is a diagram illustrating the configuration of the light source device 100. The light source device 100 includes the light source unit 110 and the discharge lamp driving device 200, as described above. The light source unit 110 includes a discharge lamp 500, a primary reflecting mirror 112 having a spheroidal reflecting surface, and a collimating lens 114 collimating its output beam in an almost parallel beam. However, the reflecting surface of the primary reflecting mirror 112 may not be necessarily spheroidal. For example, the reflecting surface of the primary reflecting mirror 112 may have a rotated parabola shape. In this case, when a light-emitting portion of the discharge lamp 500 is located at a focal point of the parabolic mirror, the collimating lens 114 can be omitted. The primary reflecting mirror 112 and the discharge lamp 500 are bonded to each other with an inorganic adhesive 116.

The discharge lamp 500 is formed by bonding a discharge lamp body 510 to a secondary reflecting mirror 520 having a spherical reflecting surface with an inorganic adhesive 522. The discharge lamp body 510 is formed of a glass material such as quartz glass. The discharge lamp body 510 is provided with two electrodes 610 and 710 formed of a high-melting-point metal electrode material such as tungsten, two connection members 620 and 720, and two electrode terminals 630 and 730. The electrodes 610 and 710 are arranged so that the tips thereof face each other in a discharge space 512 formed at the center of the discharge lamp body 510. Gas including rare gas and mercury or metal halides is enclosed as a discharge medium in the discharge space 512. The connection members 620 and 720 are members serving to electrically connect the electrodes 610 and 710 to the electrode terminals 630 and 730, respectively.

The electrode terminals 630 and 730 of the discharge lamp 500 are connected to the output terminals of the discharge lamp driving device 200. The discharge lamp driving device 200 is connected to the electrode terminals 630 and 730 and supplies a pulse-like AC current (AC pulse current) to the discharge lamp 500. When the AC pulse current is supplied to the discharge lamp 500, an arc AR is generated between the tips of two electrodes 610 and 710 in the discharge space 512. The arc AR emits light in all directions from the generation position of the arc AR. The secondary reflecting mirror 520 reflects the light emitted to one electrode 710 toward the primary reflecting mirror 112. In this way, by reflecting the light emitted to the electrode 710 toward the primary reflecting mirror 112, the light emitted to the electrode 710 can be effectively utilized.

Figure 3:
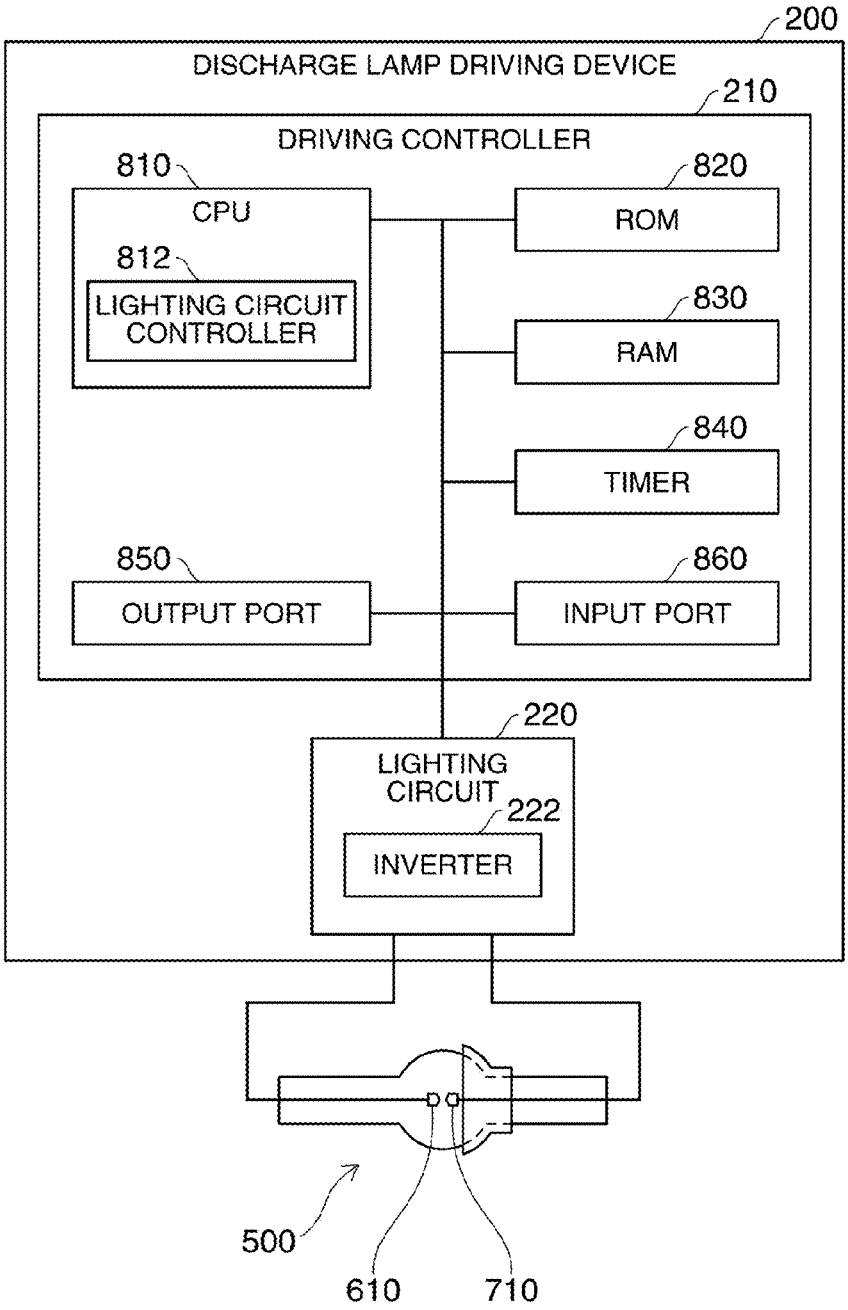
FIG. 3 is a block diagram illustrating the configuration of a discharge lamp driving device.

FIG. 3 is a block diagram illustrating the configuration of the discharge lamp driving device 200. The discharge lamp driving device 200 includes a driving controller 210 and a lighting circuit 220. The driving controller 210 is constructed as a computer including a CPU 810, a ROM 820, a RAM 830, a timer 840, an output port 850 for outputting a control signal to the lighting circuit 220, and an input port 860 for acquiring the signal from the lighting circuit 220. The CPU 810 of the driving controller 210 embodies the function of a lighting circuit controller 812 by executing a program stored in the ROM 820. The lighting circuit 220 in this embodiment corresponds to the discharge lamp lighting unit in the claims and the lighting circuit controller 812 corresponds to the controller in the claims.

The lighting circuit 220 has an inverter 222 generating the AC pulse current. The inverter 222 includes a DC current control circuit (not shown) and an AC conversion circuit (not shown). The DC current control circuit has a DC source (not shown) as an input, drops the input voltage and outputs a DC current Id. The AC conversion circuit generates and outputs a discharge-lamp driving current having arbitrary frequency and duty ratio by inverting the polarity of the DC current Id output from the DC current control circuit at a predetermined time.

The lighting circuit 220 supplies the AC pulse current with steady power (for example, 200 W) to the discharge lamp 500 by controlling the inverter 222 on the basis of the control signal supplied from the driving controller 210 via the output port 850. Specifically, the lighting circuit 220 controls the inverter 222 to generate the AC pulse current corresponding to the specified electric supply condition (for example, the frequency, the duty ratio, and the current waveform of the AC pulse current). The lighting circuit 220 supplies the AC pulse current generated by the inverter 222 to the discharge lamp 500.

The lighting circuit 220 detects the supplied power Pp supplied to the discharge lamp 500 and the applied voltage Vp applied across the electrodes 610 and 710. The supplied power Pp and the applied voltage Vp detected by the lighting circuit 220 are acquired by the lighting circuit controller 812 of the driving controller 210 via the input port 860.

The lighting circuit controller 812 controls the lighting circuit 220 to modulate the duty ratio of the AC pulse current. The control of the modulation of the duty ratio of the AC pulse current is called duty ratio modulation control in this embodiment. That is, the lighting circuit controller 812 generates a control signal (also referred to as "duty ratio modulation control signal") for performing the duty ratio modulation control and outputs the control signal to the lighting circuit 220 via the output port 850. The duty ratio modulation pattern (first modulation pattern) will be described later.

As described above, the lighting circuit controller 812 determines whether the supplied power Pp detected by the lighting circuit 220 reaches a power value P1 (for example, 200 W), and controls the timer 840 to start the count of time when the supplied power Pp reaches the power value P1. The lighting circuit controller 812 determines whether time T1 has passed after the power supplied to the discharge lamp 500 reaches the power value P1 on the basis of the output of the timer 840. The lighting circuit controller 812 outputs the duty ratio modulation control signal when it is determined that the time T1 has passed.

A-2. Duty Ratio Modulation Pattern

Figure 4:
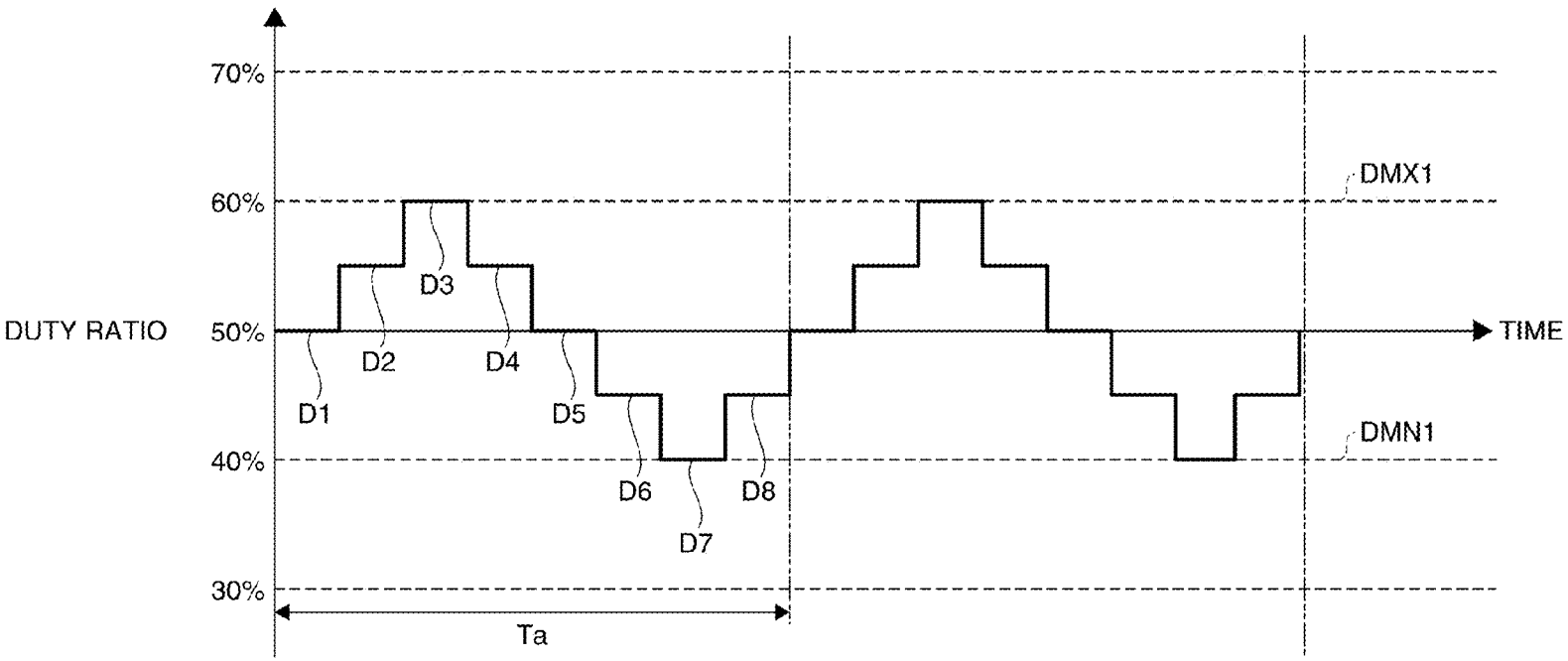
FIG. 4 is a diagram illustrating an example of a duty ratio modulation pattern (first modulation pattern) of an AC pulse current supplied to a discharge lamp.

FIG. 4 is a diagram illustrating an example of a duty ratio modulation pattern (first modulation pattern) of the AC pulse current supplied to the discharge lamp 500. In the drawing, the horizontal axis represents the time and the vertical axis represents the duty ratio. Here, the duty ratio means a ratio of the time in which two electrodes 610 and 710 respectively operate as a positive electrode to one period of the AC pulse current. For example, FIG. 4 shows the duty ratio of the electrode 610. In this embodiment, a reference duty ratio is 50%. In this embodiment, the driving power of the discharge lamp 500 is 200 W and the driving power is the substantial average power in one period of the first modulation pattern.

As shown in the drawing, when the modulation period of the first modulation pattern is Ta, the duty ratio is changed by steps of 5% every ⅛th of the modulation period Ta. Hereinafter, the time corresponding to each ⅛th of the modulation period Ta is called the "sub period". Each of the sub periods D1 to D8 is a period in which the duty ratio of the AC pulse current for driving the discharge lamp is kept constant. Specifically, in the first modulation pattern, the duty ratio is 50% in the sub period D1, the duty ratio is then raised by 5%, and the duty ratio is the maximum of 60% in the sub period D3. Thereafter, the duty ratio is lowered by 5% and the duty ratio is the minimum of 40% in the sub period D7. Thereafter, the duty ratio is raised by 5% and the raising and lowering of the duty ratio is repeated with the period Ta. That is, in this embodiment, the differences between the maximum value DMX1 (60%) and the minimum value DMN1 (40%) of the duty ratio of the AC pulse current for driving the discharge lamp and the reference duty ratio (50%) are all 10%.

In this embodiment, the modulation period Ta of the first modulation pattern is 64 seconds and the length of one sub period is 8 seconds. However, the length of the modulation period Ta or the sub period can be properly changed on the basis of the characteristics of the discharge lamp 500 or the electrical supply condition thereof.

Figure 5:
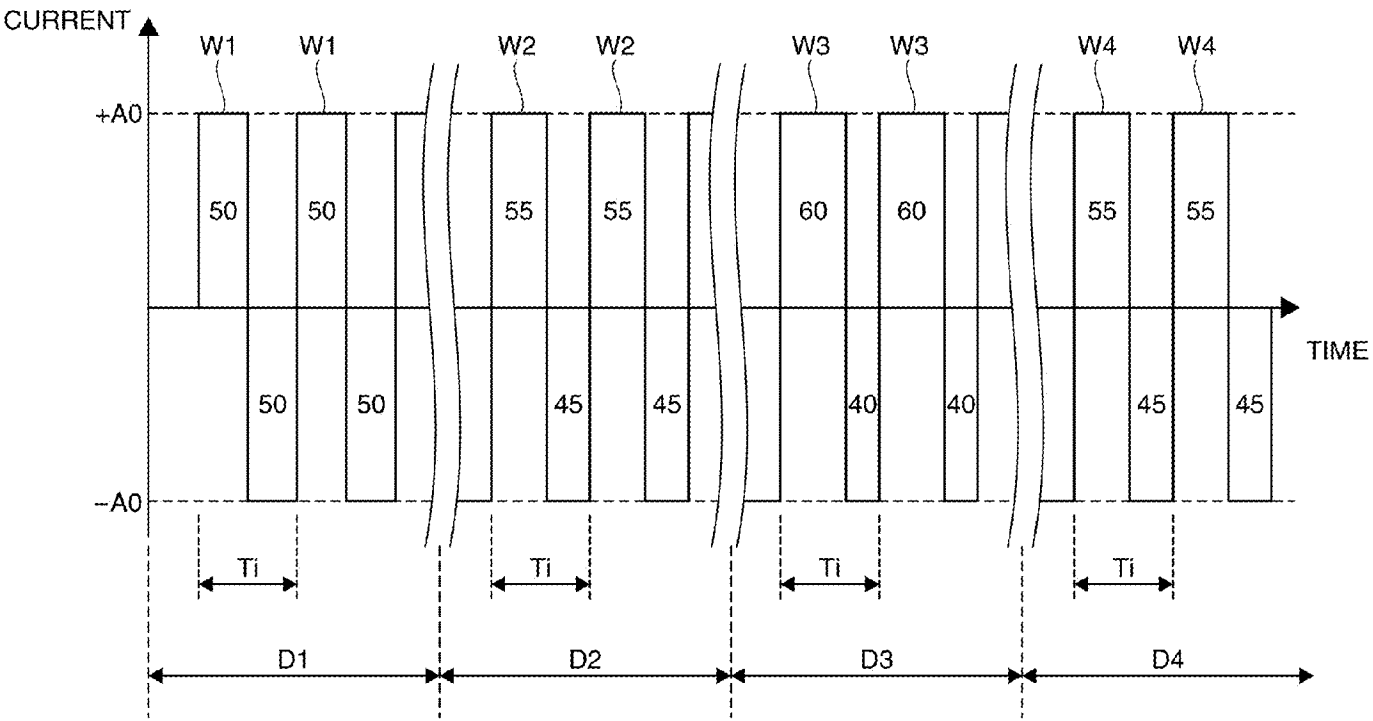
FIG. 5 is a diagram illustrating a waveform variation of the AC pulse current when the duty ratio is modulated in the first modulation pattern.
Figure 6:
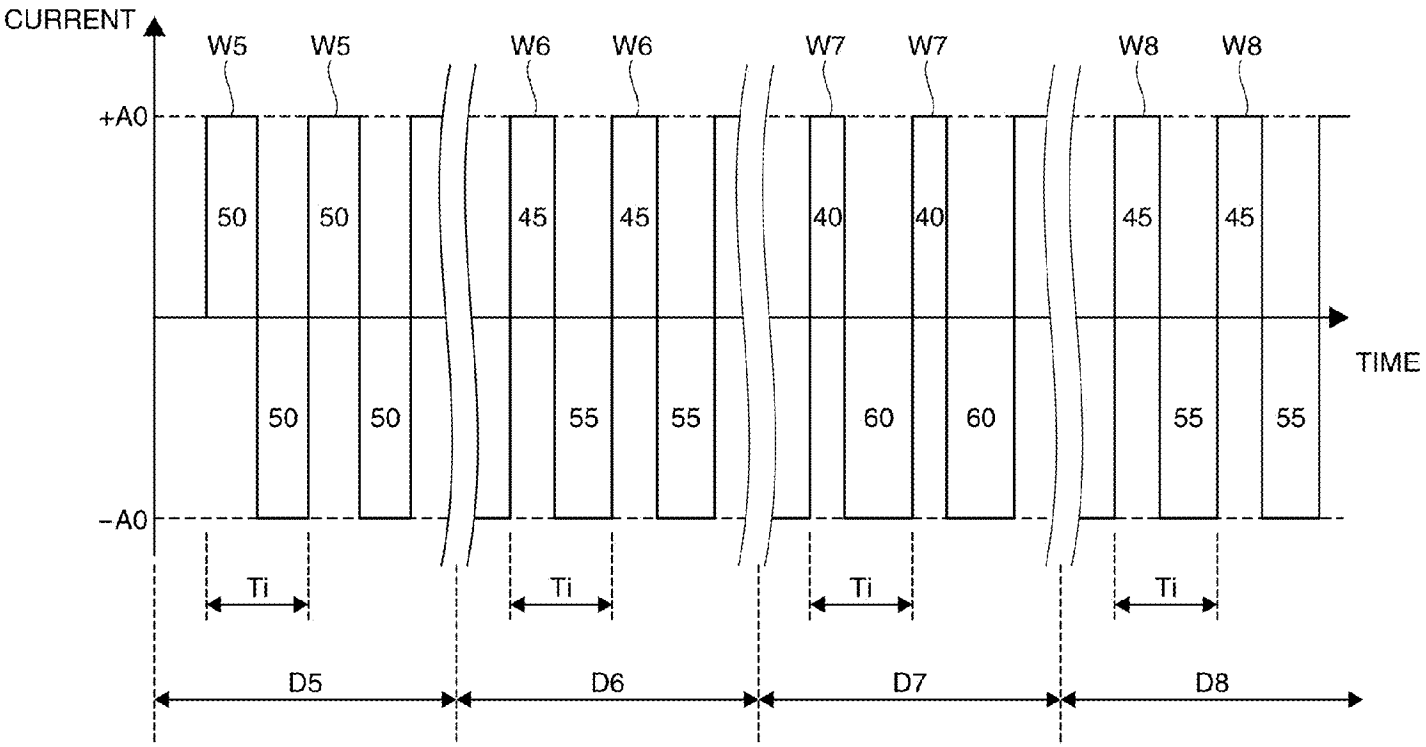
FIG. 6 is a diagram illustrating the waveform variation of the AC pulse current when the duty ratio is modulated in the first modulation pattern.

FIGS. 5 and 6 are diagrams illustrating a waveform variation of the AC pulse current when the duty ratio is modulated in the first modulation pattern shown in FIG. 4. The horizontal axis represents the time and the vertical axis represents the current value. FIG. 5 shows the sub periods D1, D2, D3, and D4, and FIG. 6 shows the sub periods D5, D6, D7, and D8. In FIGS. 5 and 6, the positive direction of the supplied current is the direction in which the current flows from the electrode 610 to the electrode 710. That is, the electrode 610 operates as a positive electrode when the supplied current Ip has a positive value, and the electrode 610 operates as a negative electrode when the supplied current Ip has a negative value.

As shown in FIG. 5, in the sub period D1, a current waveform with a duty ratio of 50% is maintained. In the sub period D1, one period of the AC pulse current flowing between the electrode 610 and the electrode 710 is Ti. In the sub period D2, the current waveform is changed to a current waveform with a duty ratio of 55%, which is maintained in the sub period D2. In the sub period D2, one period of the AC pulse current is Ti, similarly to the sub period D1. In the sub period D3, the current waveform is changed to a current waveform with a duty ratio of 60%, which is maintained in the sub period D3. In the sub period D3, one period of the AC pulse current is Ti, similarly to the sub period D1. In the sub period D4, the current waveform is changed to a current waveform with a duty ratio of 55%, which is maintained in the sub period D4. In the sub period D4, one period of the AC pulse current is Ti, similarly to the sub period D1.

As shown in FIG. 6, in the sub period D5, a current waveform with a duty ratio of 50% is maintained. In the sub period D6, the current waveform is changed to a current waveform with a duty ratio of 55%, which is maintained in the sub period D6. In the sub period D7, the current waveform is changed to a current waveform with a duty ratio of 60%, which is maintained in the sub period D7. In the sub period D8, the current waveform is changed to a current waveform with a duty ratio of 55%, which is maintained in the sub period D8. In any of the sub periods D5 to D8, one period of the AC pulse current is Ti, similarly to the sub period D1.

That is, as shown in FIGS. 5 and 6, in any of the 8 sub periods D1 to D8 having different duty ratios, one period Ti of the AC pulse current flowing between the electrode 610 and the electrode 710 is constant. Accordingly, the frequency (fi=1/Ti) of the AC pulse current is constant all over the modulation period Ta. On the other hand, the positive-electrode times W1 to W8 of the electrode 610 are set to different values in the sub periods D1 to D8 having different duty ratios. In the first embodiment, by changing the positive-electrode time W with the frequency fi (hereinafter, also referred to as "driving frequency fi") of the AC pulse current constant, the duty ratio is modulated. The driving frequency fi need not be constant. In this embodiment, the differences between the maximum value and the minimum value of the duty ratio and the reference duty ratio are constant, but any one may be greater.

A-3. Advantage of Duty Ratio Modulation Control

Figure 7:
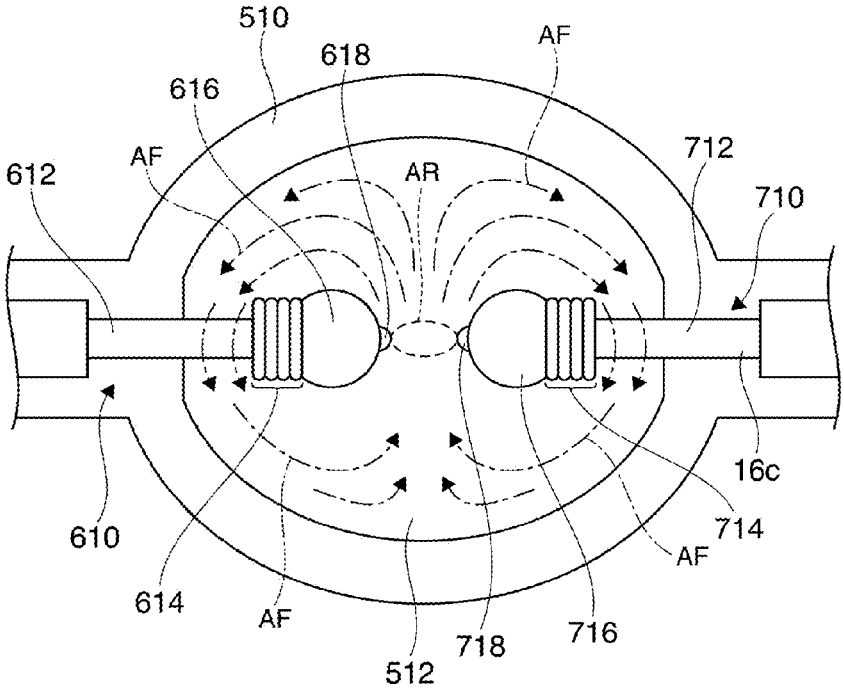
FIG. 7 is a diagram illustrating the convection in a discharge space formed in a discharge lamp body of the discharge lamp.

As described above, in the projector 1000 according to this embodiment, the driving power is supplied to the discharge lamp 500 while modulating the duty ratio of the AC pulse current. FIG. 7 is a diagram illustrating the convection in the discharge space 512 formed in the discharge lamp body 510 of the discharge lamp 500. As shown in the drawing, the electrode 610 includes a core 612, a coil portion 614, a body portion 616, and a protrusion 618. The electrode 610 is formed by winding a wire of an electrode material (such as tungsten) on the core 612 to form the coil portion 614 and heating and melting the formed coil portion 614 before enclosing it in the discharge lamp body 510. Accordingly, the body portion 616 having great heat capacity and the protrusion 618 which is the position at which the arc AR is generated are formed in the tip of the electrode 610. The electrode 710 is also formed in the same way as the electrode 610.

When the discharge lamp 500 lights up, the gas enclosed in the discharge space 512 is heated by the generated arc AR and is convected in the discharge space 512. Specifically, since the arc AR and the area in the vicinity thereof have a very high temperature, the convection AF (indicated by the one-dot-chained line in FIG. 7) flowing from the arc AR to the upside is formed in the discharge space 512. As shown in FIG. 7, the convection AF comes in contact with the discharge lamp body 510, moves along the inner wall of the discharge lamp body 510, and is cooled and moves down by passing through the cores 612 and 712 of both electrodes 610 and 710. The moved-down convection AF further moves down along the inner wall of the discharge space 512, collides with each other below the arc AR, and moves up again to the arc AR.

FIGS. 8A and 8B are diagrams schematically illustrating the influence of the duty ratio modulation on the electrodes 610 and 710. FIG. 8A shows the central portion of the discharge lamp 500 when the discharge lamp 500 is driven without modulating the duty ratio. FIG. 8B shows the central portion of the discharge lamp 500 when the discharge lamp 500 is driven with the modulation of the duty ratio.

When the duty ratio of the AC pulse current is not modulated, the temperature distributions in both electrodes 610 and 710 are steady. Since the temperature distributions in both electrodes 610 and 710 are steady, the convection AF of the gas is steady, as shown in FIG. 7. The gas being convected in the discharge space 512 includes the electrode material melted and evaporated by the arc AR. Accordingly, when the steady convection is formed, as shown in FIG. 8A, the electrode material is locally deposited on the cores 612 and 712 or the coil portions 614 and 714 having a relatively low temperature, and a needle-shaped crystal WSK of the electrode material grows therefrom.

When the needle-shaped crystal WSK grows in this way and the temperatures of the body portions 616 and 716 or the protrusions 618 and 718 are not sufficiently raised at the time of starting up the discharge lamp or the like, an arc may be generated from the needle-shaped crystal WSK to the inner wall of the discharge lamp body 510. When the arc is generated from the needle-shaped crystal WSK to the inner wall of the discharge lamp body 510, the inner wall may deteriorate. When the arc is generated from the needle-shaped crystal WSK to the inner wall of the discharge space 512, the discharge lamp body 510 formed of glass may be evaporated and thus a halogen cycle may become abnormal. The halogen cycle in this specification means a cycle series in which the electrode material in the body portions 616 and 716 or the protrusions 618 and 718 having a high temperature is evaporated to form halides and the halides of the electrode material existing in the discharge space 512 are decomposed again to deposit the electrode material on the electrodes 610 and 710.

In this way, when the duty ratio of the AC pulse current supplied to the discharge lamp is not modulated, the needle-shaped crystal WSK grows to cause the deterioration of the inner wall or the abnormality of the halogen cycle, thereby shortening the lifetime of the discharge lamp. On the other hand, when the duty ratio of the AC pulse current supplied to the discharge lamp is modulated, the temperature distributions in both electrodes 610 and 710 vary with the passing of time. Accordingly, the steady convection is stopped from being generated in the discharge space 512 and the local deposition of the electrode material and the growth of the needle-shaped crystal are suppressed (FIG. 8B).

A-4. Start Time of Duty Ratio Modulation Control

Figure 9:
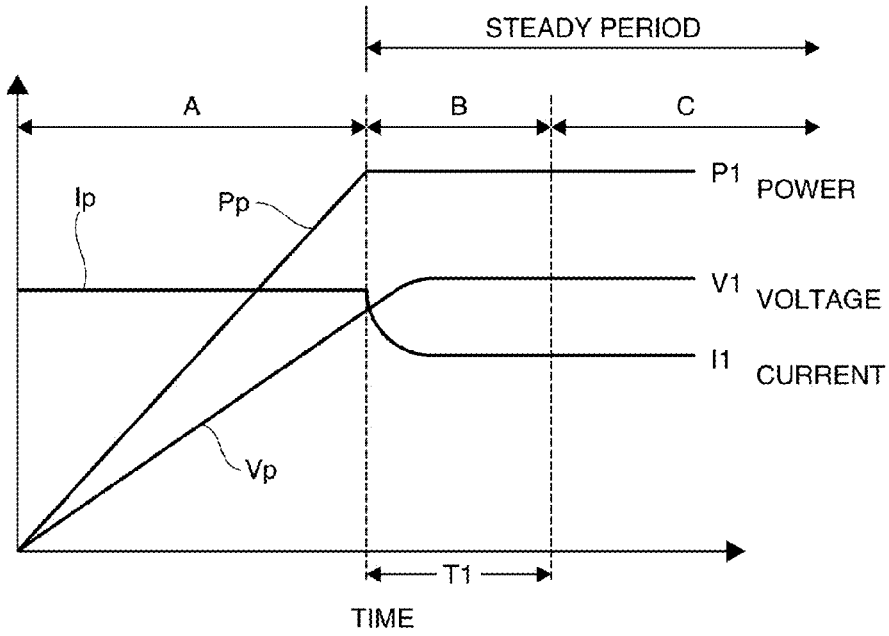
FIG. 9 is a diagram illustrating the temporal variations of a supplied power, an applied voltage, and a supplied current after the discharge lamp is started up.

In the projector 1000 according to this embodiment, the duty ratio modulation control is started on the basis of the supplied power Pp supplied to the discharge lamp 500. FIG. 9 is a diagram illustrating the temporal variations of the supplied power Pp, the applied voltage Vp applied across the electrodes 610 and 710, and the supplied current Ip after the discharge lamp 500 is started up. As shown in the drawing, the period of time until the supplied power Pp reaches the power value P1 after starting up the discharge lamp 500 is "period A", the period until the time T1 after the supplied power Pp reaches the power value P1 is "period B", and the period after the time T1 has passed after the supplied power Pp reaches the power value P1 is "period C". In this embodiment, the period (that is, period B and period C) in which the supplied power Pp is maintained in the power value P1 is also called the "steady period".

As described above, the lighting circuit controller 812 controls the lighting circuit 220 so that the supplied power (200 W) is P1. As shown in the drawing, in period A, the lighting circuit controller 812 controls the lighting circuit 220 to supply a constant current to the discharge lamp 500. At this time, the lighting circuit 220 is controlled to supply the constant current with a constant duty ratio (50%) instead of making the duty ratio modulation control. As shown in the drawing, in period A, the applied voltage Vp applied across both electrodes 610 and 710 increases with the passing of time by the increase in temperature or pressure in the discharge lamp 500.

The supplied power Pp increases with the increase in the applied voltage Vp. That is, in period A, the supplied power Pp increases.

As described above, the applied voltage Vp increases with the increase in temperature or pressure in the discharge lamp 500. Accordingly, as shown in the drawing, even when the supplied power Pp reaches the power value P1 (that is, even in period B), the applied voltage Vp continuously increases. In period B, the lighting circuit controller 812 controls the lighting circuit 220 to reduce the supplied current Ip on the basis of the applied voltage Vp so as to maintain the power value of the supplied power Pp in P1 (constant) (FIG. 9). When the supplied current Ip is controlled in this way, the applied voltage Vp is stabilized and the supplied current Ip is stabilized in period B. In period C, the supplied current Ip and the applied voltage Vp are stabilized to be constant and the supplied power Pp is thus stabilized to be constant (P1).

In the projector 1000 according to this embodiment, the lighting circuit controller 812 (see FIG. 3) starts the duty ratio modulation control in period C (see FIG. 9). This is to start the duty ratio modulation control after the supplied current Ip and the applied voltage Vp are sufficiently stabilized. The time T1 in period B is a time sufficient for stabilizing the supplied current Ip in the current value I1 and stabilizing the applied voltage Vp in the voltage value V1. The time T1 is determined in advance by experiments in consideration of a margin including individual difference or temporal deterioration. In this embodiment, when the time T1 has passed after the supplied power Pp reaches the power value P1, the duty ratio modulation control is started. However, the duty ratio modulation control may be started on the basis of the value of the applied voltage VP or the supplied current Ip. For example, the duty ratio modulation control may be started when the applied voltage Vp reaches the voltage value V1, or the duty ratio modulation control may be started when the supplied current Ip reaches the current value I1.

A-5. Example

As described above, the start time of the duty ratio modulation control is determined on the basis of the electrical behaviors (current, voltage, and power) of the discharge lamp. Therefore, the electrical behaviors of the discharge lamp are shown as an experimental example when the discharge lamp is started by the constant current control using a 200 W discharge lamp and a 230 W discharge lamp. In the experimental example, as the constant current control, a constant current is supplied to the discharge lamp until the power supplied to the discharge lamp reaches a predetermined power value (rated power), and the current is supplied so that a predetermined power is maintained after the power reaches the predetermined power. Specifically, since the voltage increases with the passing of time by the increase in temperature or pressure in the discharge lamp, the supplied current is lowered after the power reaches a predetermined power value. The current supplied to the discharge lamp is a rectangular AC current and the duty ratio thereof is 50%. In the experimental example, a discharge lamp mounted with a secondary mirror is used.

Figure 10:
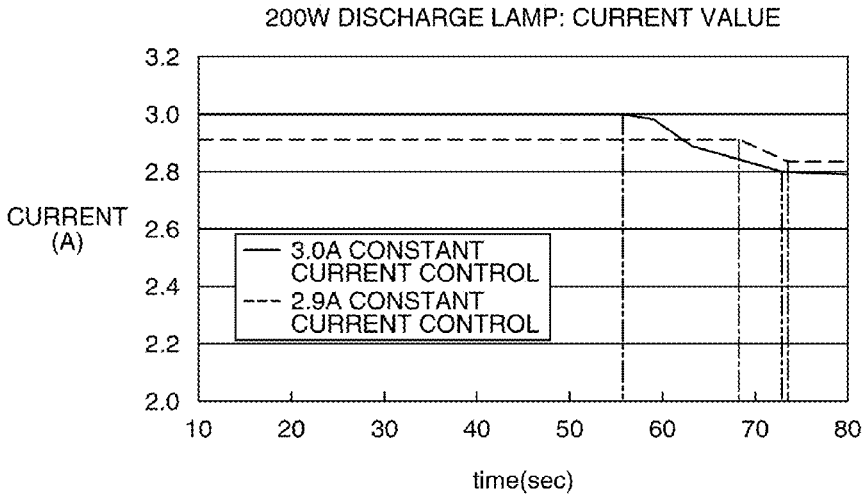
FIG. 10 is a graph illustrating the temporal variation in the current of a 200 W discharge lamp.
Figure 11:
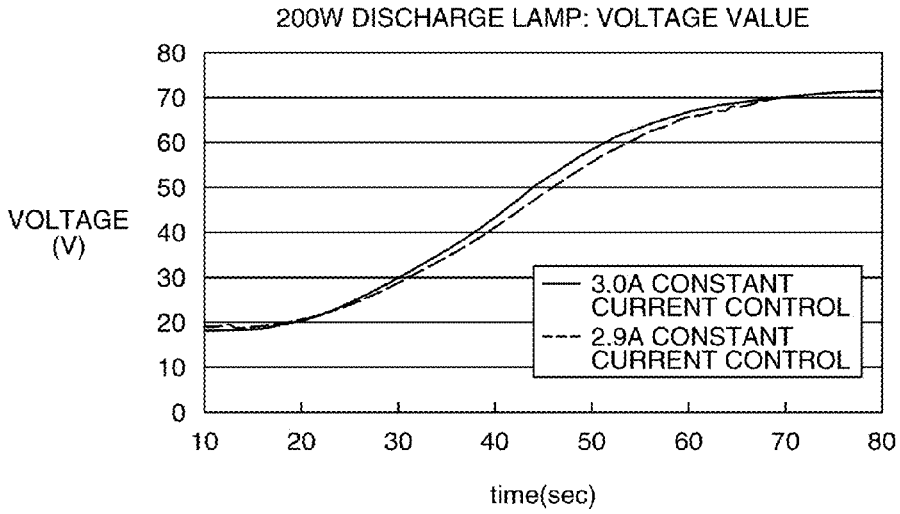
FIG. 11 is a graph illustrating the temporal variation in the voltage of the 200 W discharge lamp.
Figure 12:
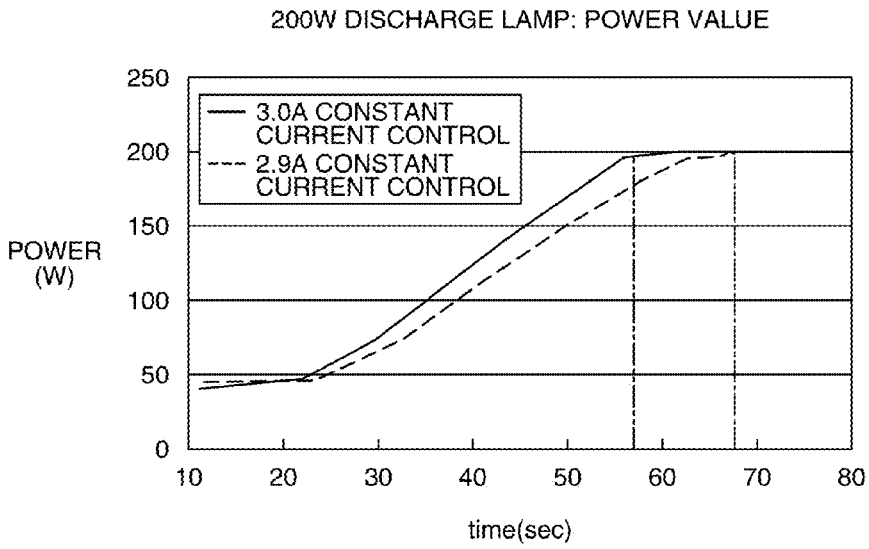
FIG. 12 is a graph illustrating the temporal variation in the power of the 200 W discharge lamp.

FIG. 10 is a graph illustrating the temporal variation in the current in the 200 W discharge lamp, FIG. 11 is a graph illustrating the temporal variation in the voltage in the 200 W discharge lamp, and FIG. 12 is a graph illustrating the temporal variation in the power in the 200 W discharge lamp. In FIGS. 10 to 12, the result of the 3.0 A constant current control is indicated by the solid line and the result of the 2.9 A constant current control is indicated by the broken line.

As shown in FIGS. 10 to 12, when a constant current is supplied to the discharge lamp, the voltage increases with the passing of time and the power increases with the increase in voltage. When the 3.0 A constant current control is carried out, the power reaches 200 W (rated power) in about 56 seconds (FIG. 12). In the experimental example, when the power reaches a predetermined power value (rated power), the control for decreasing the supplied current is carried out to maintain the power to be constant (FIG. 10). In this way, when the control for decreasing the supplied current is carried out to maintain the power to be constant, the supplied current is almost constant (about 2.8 A) in about 73 seconds. That is, when 17 seconds have passed after the power reaches the predetermined power (200 W), the supplied current is almost constant.

The start time of the duty ratio modulation control may be determined on the basis of the experimental example. For example, when the supplied current reaches about 2.8 A and the excessive melting of the electrodes hardly occurs even by the modulation of the positive-electrode duty ratio to 70%, the duty ratio modulation control may be started after the supplied current reaches about 2.8 A. Therefore, when the 3.0 A constant current control is carried out on the 200 W discharge lamp, the duty ratio modulation control is started in 13 seconds after the power reaches 200 W. That is, the time T1 may be set to 17 seconds. The time T1 may be set to 10 seconds or more, and in certain embodiments 20 seconds or more, in consideration of the stability of the current, the individual differences, and the temporal deterioration.

Similarly, when the 2.9 A constant current control is carried out, the power reaches 200 W (rated power) in about 68 seconds (FIG. 12). Thereafter, when the control for decreasing the supplied current is carried out to maintain the power to be constant, the supplied current is almost constant (about 2.83 A) in about 74 seconds. That is, when about 6 seconds have passed after the power reaches the predetermined power (200 W), the supplied current is almost constant (about 2.83 A). Therefore, when the 2.9 A constant current control is carried out on the 200 W discharge lamp, the duty ratio modulation control is started in 6 seconds after the power reaches 200 W. That is, the time T1 may be set to 6 seconds. The time T1 may be set to 6 seconds or more in consideration of the stability of the current, the individual differences, and the temporal deterioration.

Figure 13:
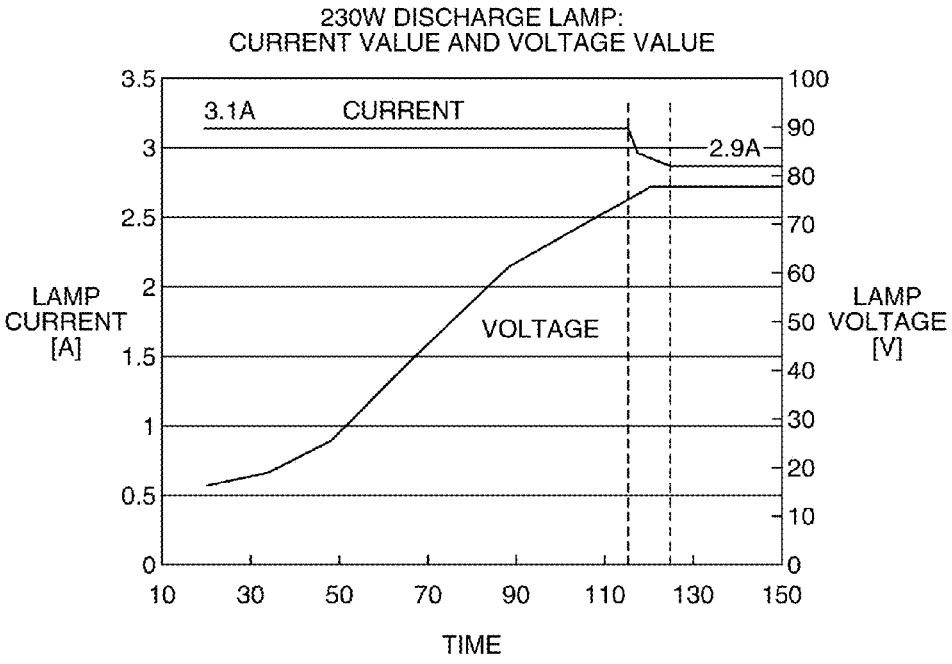
FIG. 13 is a graph illustrating the temporal variation in the current and voltage of a 230 W discharge lamp.
Figure 14:
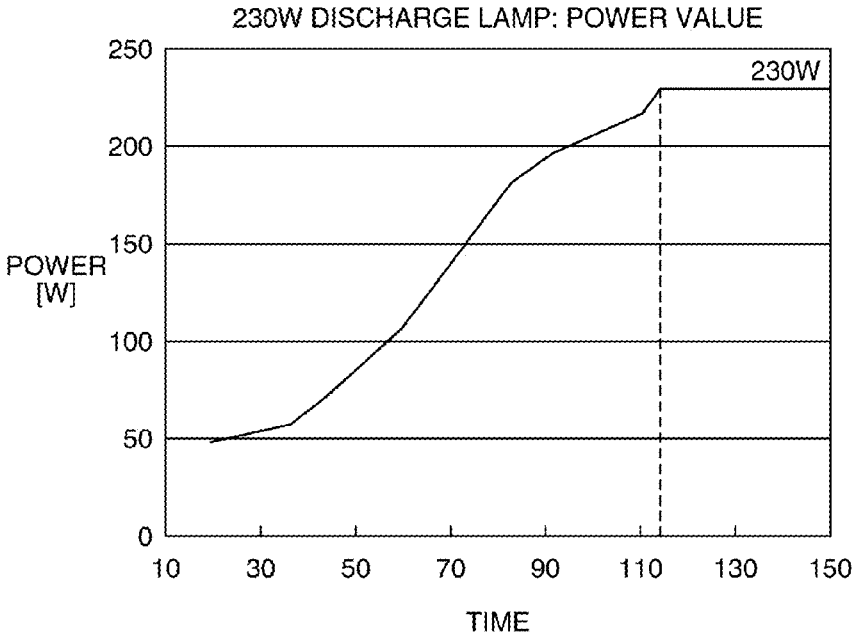
FIG. 14 is a graph illustrating the temporal variation in the power of a 230 W discharge lamp.

FIG. 13 is a graph illustrating the temporal variations in the current and voltage in the 230 W discharge lamp and FIG. 14 is a graph illustrating the temporal variation in the power in the 230 W discharge lamp. When the 230 W discharge lamp is used, the constant current control is carried out in the same way as using the 200 W discharge lamp. As shown in FIGS. 13 and 14, when a constant (3.1 A) current is supplied to the 230 W discharge lamp, the voltage increases with the passing of time and the power increases with the increase in voltage. The power reaches about 230 W (rated power) in about 114 seconds (FIG. 14). Thereafter, when the control for decreasing the supplied current is carried out to maintain the power to be constant, the supplied current is almost constant (about 2.9 A) in about 123 seconds. That is, when about 9 seconds have passed after the power reaches the predetermined power (230 W), the supplied current is almost constant.

The start time of the duty ratio modulation control may be determined on the basis of the experimental example. For example, when the supplied current reaches about 2.9 A and the excessive melting of the electrodes is hardly occurs even by the modulation of the positive-electrode duty ratio to 60%, the duty ratio modulation control may be started after the supplied current reaches about 2.9 A. Therefore, when the 3.1 A constant current control is carried out on the 230 W discharge lamp, the duty ratio modulation control is started in 9 seconds after the power reaches 230 W. That is, the time T1 may be set to 9 seconds. The time T1 may be set to 9 seconds or more and, in certain embodiments, 20 seconds or more in consideration of the stability of the current, the individual differences, and the temporal deterioration.

The experiment results have been described when the 200 W discharge lamp is started up by the 3.0 A constant current control, when the 200 W discharge lamp is started up by the 2.9 A constant current control, and when the 230 W discharge lamp is started up by the 3.1 A constant current control, but the disclosure is not limited to these experimental examples. The experiments may be carried out depending on the driving power (rated power) of the employed discharge lamp, the current value in the constant current control, and the existence of the second mirror to set the time T1.

A-6. Operation

Figure 15:
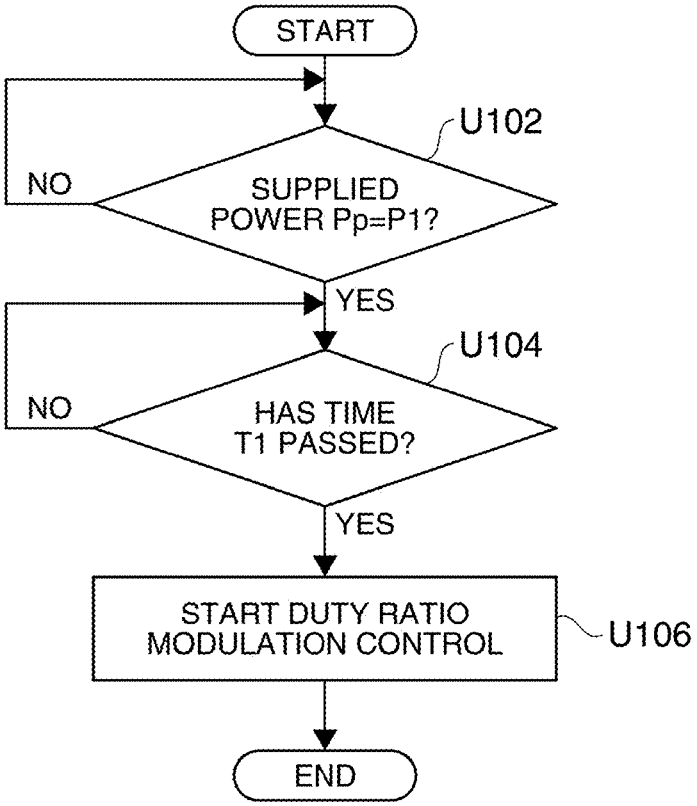
FIG. 15 is a flowchart illustrating the flow of a duty ratio modulation control starting process.

The process of stating the duty ratio modulation control in the projector 1000 according to this embodiment will be described with reference to FIG. 15. FIG. 15 is a flowchart illustrating the flow of the process of starting the duty ratio modulation control. As described above, when the discharge lamp 500 is started up, the lighting circuit controller 812 acquires the detected value of the supplied power Pp from the lighting circuit 220. As shown in FIG. 15, the lighting circuit controller 812 determines whether the supplied power Pp is equal to P1 (step U102). The lighting circuit controller 812 performs the process of step U102 when it is determined that the supplied power Pp is not equal to P1 (NO in step U102). That is, the lighting circuit controller 812 repeats the process of step U102 until the supplied power Pp is equal to P1.

When the supplied power Pp is equal to P1 (YES in step U102), the lighting circuit controller 812 determines whether the time (the time which has passed after the supplied power Pp became equal to P1) input from the timer 840 passes through the time T1 (step U104). When it is determined that the time T1 has not passed after the supplied power Pp became equal to P1 (NO in step U104), the lighting circuit controller 812 performs the process of step U104 again. That is, the lighting circuit controller 812 repeats the process of step U104 until the time T1 has passed after the supplied power Pp became equal to P1. When it is determined that the time T1 has passed after the supplied power Pp became equal to P1 (YES in step U104), the lighting circuit controller 812 starts the duty ratio modulation control in the first modulation pattern.

A-7. Advantages

Figure 16A:
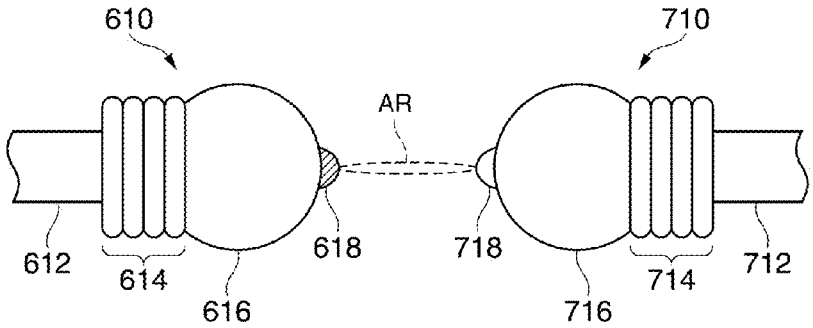
FIGS. 16A, 16B, and 16C are diagrams conceptually illustrating the variation in the shape of electrodes accompanied with the use of the discharge lamp in a comparative example.
Figure 16B:
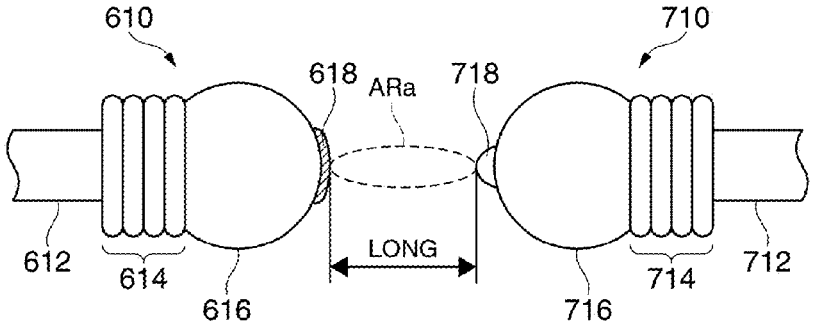
Figure 16C:
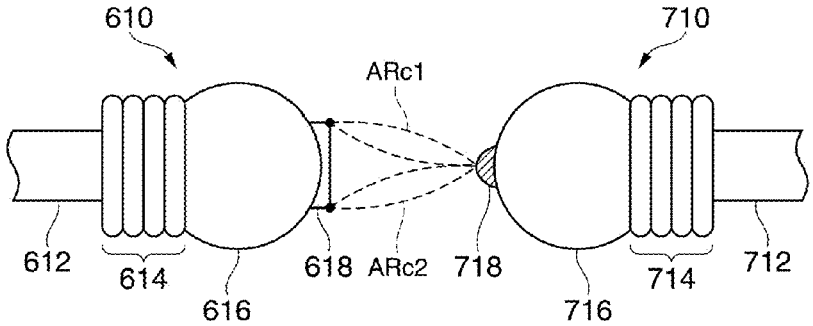

The projector 1000 according to this embodiment will be described in comparison with the case (comparative example) where the duty ratio modulation control is started at the same time as the start of period B (see FIG. 9). FIGS. 16A, 16B, and 16C are diagrams conceptually illustrating the variation in the shape of the electrodes 610 and 710 accompanied with the usage of the discharge lamp 500 in the comparative example. FIG. 16A shows the tips of the electrodes 610 and 710 in the initial stage of using the discharge lamp 500. In FIG. 16A, the electrode 610 operates as the positive electrode. FIGS. 16B and 16C show the tips of the electrodes 610 and 710 of the discharge lamp 500 after starting the duty ratio modulation control. The electrode 610 operates as the positive electrode in FIG. 16B and the electrode 610 operates as the negative electrode in FIG. 16C. In FIGS. 16A, 16B, and 16C, the state where the polarity of the electrode is positive and the protrusion is melted is hatched.

In the initial stage (period A in FIG. 9) of using the discharge lamp 500, as shown in FIG. 16A, the outer shape of the protrusion 618 is substantially parabolic. On the contrary, when the duty ratio modulation control is started in period B of FIG. 9, as shown in FIG. 16B, the protrusion 618 of the electrode 610 operating as the positive electrode is excessively melted and thus the protrusion 618 becomes a flat shape.

The reason is as follows. The first modulation pattern used in the duty ratio modulation control is determined so that the statuses of the electrodes 610 and 710 are adequate when the supplied current Ip is equal to the current value I1, the applied voltage Vp is equal to the voltage value V1, and the supplied power Pp is equal to the power value P1. As shown in FIG. 9, in the initial stage of period B, the supplied current Ip is not stabilized in the current value I1 and the supplied current Ip is higher than the current value I1. Accordingly, when the duty ratio modulation control is started at the same time as the start of period B and the duty ratio increases, the power supplied to the positive electrode is greater than that in the current value I1, the temperature of the electrode excessively increases, and thus the electrode is excessively melted.

In this way, when the electrode is excessively melted and the shape of the protrusion 618 becomes flat as shown in FIG. 16B, the length of the arc ARa is greater than the length of the arc AR (FIG. 16A) in the initial stage of using the discharge lamp 500. Therefore, the utilization efficiency of light decreases in comparison with the case where the duty ratio modulation control is not carried out in period B. As a result, the brightness of the image projected by the projector 1000 decreases.

When the duty ratio modulation control is started in period B of FIG. 9 and the protrusion 618 of the electrode 610 operating as the positive electrode is excessively melted as shown in FIG. 16B, the protrusion 618 is hardened in the rectangular shape shown in FIG. 16C when the electrode 610 operates as the negative electrode. In the negative electrode, electrons tend to be emitted from the rectangular portion. Accordingly, as shown in FIG. 16C, the arc start point moves and the arc ARc1 or the arc ARc2 is generated. When the arc moves in this way, a flickering occurs in the image projected by the projector. In FIG. 16C, only the arc ARc1 and the arc ARc2 are shown for the purpose of clear explanation, and the arc start point may occur at three or more positions, in addition to the two positions shown.

On the contrary, in the projector 1000 according to this embodiment, the duty ratio modulation control is carried out in period C after the supplied current Ip is stabilized in the current value I1. Therefore, the temperature of the electrode can be changed in the temperature range in which the utilization efficiency of light can be maintained in an excellent status, thereby stopping the excessive melting of the electrodes. As a result, it is possible to elongate the lifetime of the discharge lamp.

B. Second Embodiment

A second embodiment will now be described. The projector according to the second embodiment is different from that of the first embodiment, in that the driving mode of the discharge lamp 500 includes a "rated power mode" and a "power save mode". In this embodiment, the driving power of the discharge lamp 500 is 200 W in the "rated power mode", and the driving power of the discharge lamp 500 is 160 W in the "power save mode". The driving mode of the discharge lamp 500 is specified by a user using operation buttons (not shown) of the projector 1000. Specifically, the discharge lamp 500 is driven in the "power save mode" when the "power save mode" button of the operation buttons is pressed, and the discharge lamp 500 is driven in the "rated power mode" when the "power save mode" button is not pressed. As described later, in this embodiment, the pattern of the duty ratio modulation control is changed depending on the driving modes. As described later, the start time of the duty ratio modulation control is changed depending on the driving modes. The driving method of the discharge lamp 500 is different from that of the first embodiment, but the configuration of the projector according to this embodiment is equal to that of the first embodiment and thus the description of the configuration is omitted.

B-1. Duty Ratio Modulation Pattern

Figure 17:
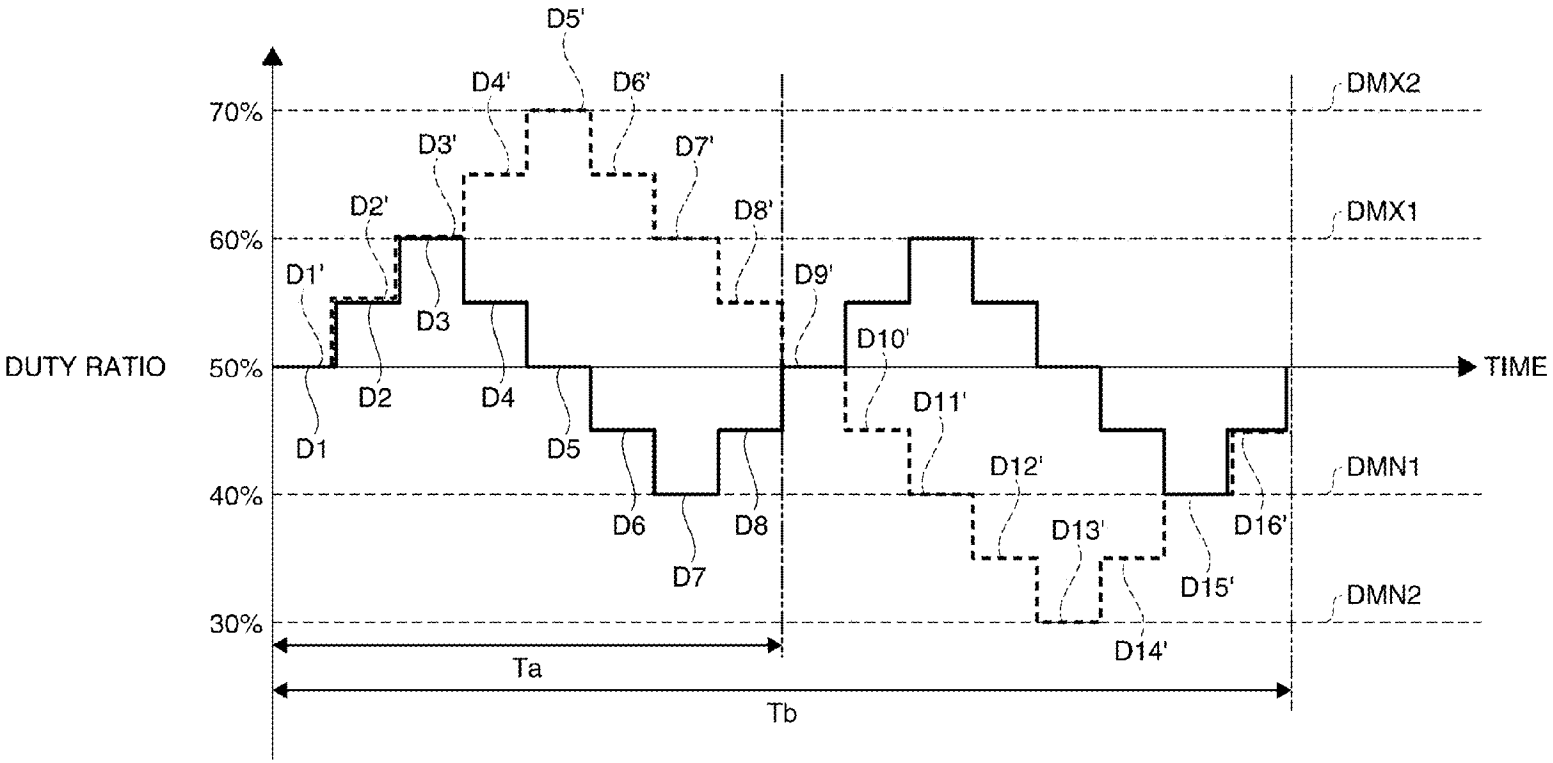
FIG. 17 is a diagram illustrating an example of a duty ratio modulation pattern of an AC pulse current supplied to the discharge lamp.

FIG. 17 is a diagram illustrating an example of a duty ratio modulation pattern of the AC pulse current supplied to the discharge lamp 500. The horizontal axis represents the time and the vertical axis represents the duty ratio. In FIG. 17, the first modulation pattern is indicated by a solid line and the second modulation pattern is indicated by a broken line. In this embodiment, the duty ratio modulation control is carried out in the first modulation pattern when the rated power mode is selected as the driving mode of the discharge lamp 500, and the duty ratio modulation control is carried out in the second modulation pattern when the power save mode is selected. The first modulation pattern is equal to the first modulation pattern in the first embodiment and thus the description thereof is omitted.

As shown in the drawing, when the modulation period of the second modulation pattern is Tb, the duty ratio is changed in steps by 5% every 1/16th of the modulation period Tb. Hereinafter, the time corresponding to each 1/16th of the modulation period Tb is called the "sub period". Each of the sub periods D1' to D8' is a period in which the duty ratio of the AC pulse current for driving the discharge lamp is kept constant. The length of each sub period in the second modulation pattern is 8 seconds similarly to the length of each sub period in the first modulation pattern.

Specifically, in the second modulation pattern, the duty ratio is 50% in the sub period D1', the duty ratio is then raised by 5%, and the duty ratio is the maximum of 70% in the sub period D5'. Thereafter, the duty ratio is lowered by 5% and the duty ratio is the minimum of 30% in the sub period D13'. Thereafter, the duty ratio is raised by 5% and the raising and lowering of the duty ratio is repeated with the period Tb.

That is, in this embodiment, when the driving power of the discharge lamp 500 is 200 W, the differences between the maximum value DMX1 (60%) and the minimum value DMN1 (40%) of the duty ratio of the AC pulse current for driving the discharge lamp and the reference duty ratio (50%) are all set to 10%. When the driving power of the discharge lamp 500 is 160 W, the differences between the maximum value DMX2 (70%) and the minimum value DMN2 (30%) of the duty ratio of the AC pulse current for driving the discharge lamp and the reference duty ratio (50%) are all set to 20%.

To suppress the formation of the steady convection accompanying the emission of light in the discharge lamp, in certain embodiments the electrode temperature is changed in as large a range as possible. However, when the driving power of the discharge lamp is small (160 W in the power save mode), the power (energy) supplied to the electrodes 610 and 710 is small and thus the changing range of the electrode temperature is narrowed. In the projector according to this embodiment, as described above, the duty ratio modulation pattern of the AC pulse current for driving the discharge lamp is changed on the basis of the driving power of the discharge lamp 500. By increasing the differences between the maximum value and the minimum value of the duty ratio and the reference duty ratio in the power save mode in comparison with the rated power mode, it is possible to change the electrode temperature in as wide a range as possible in the power save mode. Accordingly, in the power save mode, it is possible to suppress the formation of the steady convection in the discharge lamp 500, thereby preventing the partial consumption of the electrodes 610 and 710 and the partial education of the electrode material.

B-2. Start Time of Duty Ratio Modulation Control

Figure 18:
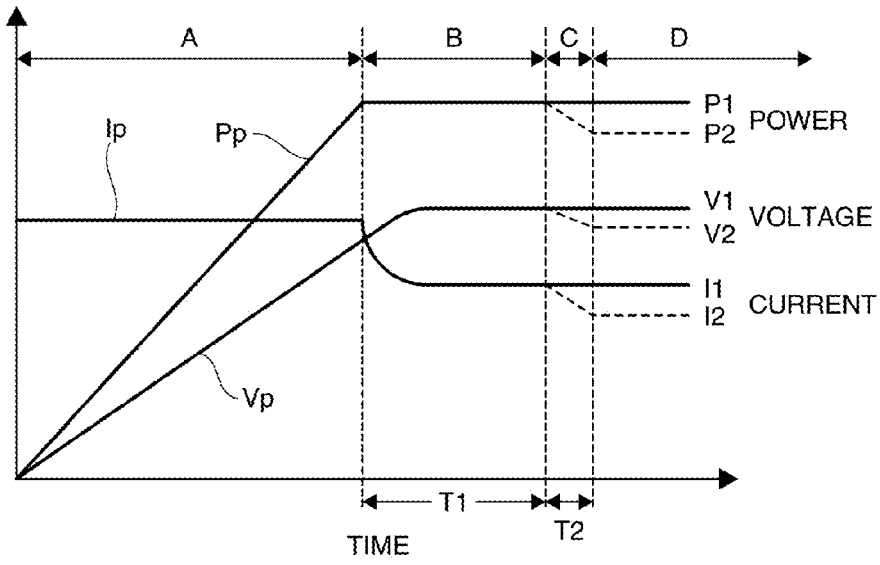
FIG. 18 is a diagram illustrating the temporal variations of a supplied power, an applied voltage, and a supplied current after the discharge lamp is started up.

In the projector according to this embodiment, the duty ratio modulation control is started on the basis of the supplied power Pp supplied to the discharge lamp 500, similarly to the first embodiment. FIG. 18 is a diagram illustrating the temporal variations of the supplied power Pp, the applied voltage Vp applied across the electrodes 610 and 710, and the supplied current Ip after starting up the discharge lamp 500. As described above, the projector according to this embodiment includes the "rated power mode" and the "power save mode" as the driving mode of the discharge lamp 500, unlike the first embodiment. In FIG. 18, the driving of the discharge lamp 500 in the rated power mode is indicated by a solid line and the driving of the discharge lamp 500 in the power save mode is indicated by a broken line. In FIG. 18, the period until the supplied power Pp reaches the power value P1 after starting up the discharge lamp 500 is "period A", the period of the time T1 after the supplied power Pp reaches the power value P1 is "period B", the period in which the supplied power Pp is controlled in the power value P2 is "period C, and the period after the supplied power Pp reaches the power value P2 is "period D".

In this embodiment, when the rated power mode is selected, that is, when the supplied power Pp is controlled in the power value P1, the duty ratio modulation control is started in the first modulation pattern at the same time as the start of period C. On the other hand, when the power save mode is selected, that is, when the supplied power Pp is controlled in the power value P2, the duty ratio modulation control is started in the second modulation pattern at the same time as the start of period D.

In this embodiment, when the power save mode is selected, as shown in FIG. 18, the supplied power Pp is first raised to the power value P1 (period A), and the supplied power Pp is controlled to become the power value P2 after the supplied current Ip and the applied voltage Vp are stabilized (period B). The reason for this control is that it takes time for the temperature in the discharge lamp 500 to reach the target value when the supplied power Pp is controlled to become the power value P2 from the first time. The applied voltage Vp depends on the temperature in the discharge lamp 500, the gas pressure in the discharge lamp 500, and the like. Accordingly, when the rise in temperature in the discharge lamp 500 is slow, it takes time for the discharge lamp 500 to light up with sufficient brightness. Therefore, the supplied power Pp is first controlled to become the power value P1 to rapidly raise the temperature in the discharge lamp 500.

B-3. Operation

Figure 19:
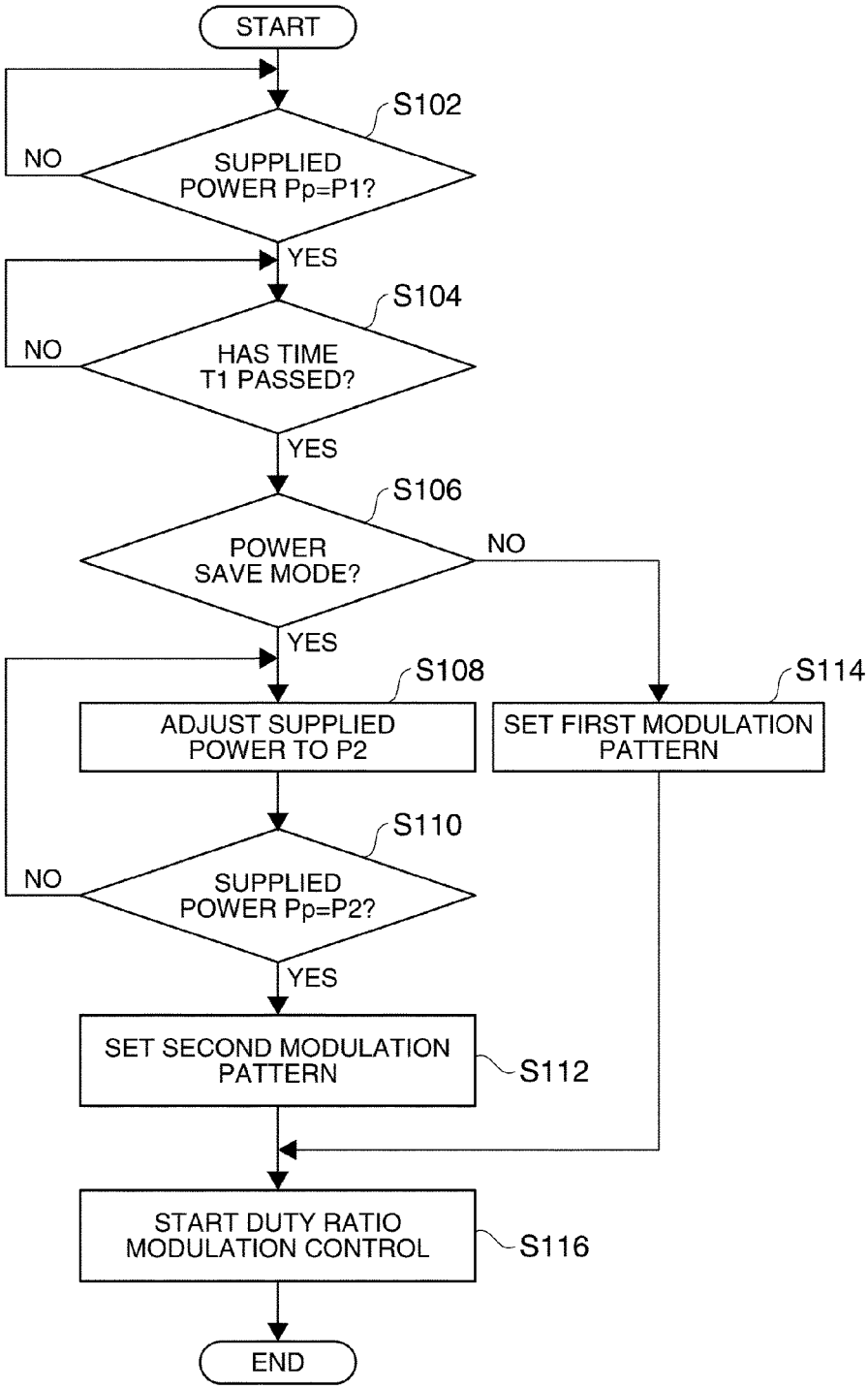
FIG. 19 is a flowchart illustrating the flow of a duty ratio modulation control starting process.

The process of starting the duty ratio modulation control in the projector according to this embodiment will be described with reference to FIG. 19. FIG. 19 is a flowchart illustrating the flow of the process of starting the duty ratio modulation control in this embodiment. Similarly to the first embodiment, when the discharge lamp 500 is started up, the lighting circuit controller 812 acquires the detected value of the supplied power Pp from the lighting circuit 220. Similarly to the first embodiment, when the supplied power Pp is equal to P1 (YES in step S102 of FIG. 19), the lighting circuit controller 812 determines whether the time passed after the supplied power Pp became equal to P1 exceeds the time T1 (step S104).

When it is determined that the time T1 has passed after the supplied power Pp became equal to P1 (YES in step S104), the lighting circuit controller 812 determines whether the driving mode of the discharge lamp 500 is the "power save mode" (step S106). As described above, a power save mode flag stored in the memory is set to ON when the "power save mode" is selected by a user operating the operation buttons (not shown), and the power save mode flag is set to OFF when the "power save mode" is not selected. The lighting circuit controller 812 determines whether the driving mode is the "power save mode" on the basis of the power save mode flag stored in the memory.

When it is determined in step S106 that the driving mode is not the "power save mode", that is, when it is determined that the driving mode is the "rated power mode", the lighting circuit controller 812 sets the modulation pattern of the duty ratio modulation control to the first modulation pattern (step S114) and starts the duty ratio modulation control (step S116). That is, when the discharge lamp 500 is driven in the "rated power mode", the duty ratio modulation control is started in the time T1 (in period C) after the supplied power Pp becomes equal to the power value P1.

On the other hand, when it is determined in step S106 that the driving mode is the "power save mode" (YES in step S106), the lighting circuit controller 812 controls the lighting circuit 220 so that the supplied power Pp is equal to the power value P2 (step S108). The lighting circuit controller 812 determines whether the supplied power Pp is equal to P2 on the basis of the detected value of the supplied power Pp input from the lighting circuit 220 (step S110). When it is determined that the supplied power Pp is not equal to the power value P2 (NO in step S110), the lighting circuit controller 812 controls the supplied power Pp to be equal to P2 in step S108 again. When it is determined that the supplied power Pp is equal to P2 (YES in step S110), the lighting circuit controller 812 sets the modulation pattern of the duty ratio modulation control to the second modulation pattern (step S112) and starts the duty ratio modulation control (step S116). That is, when the discharge lamp 500 is driven in the "power save mode" and the supplied power Pp is equal to the power value P2 (in period D), the duty ratio modulation control is started.

In this embodiment, when the discharge lamp 500 is driven in the "power save mode", the lighting circuit controller 812 starts the duty ratio modulation control on the basis of the detected value of the supplied power Pp input from the lighting circuit 220, but may start the duty ratio modulation control in a predetermined time after period C is started. The predetermined time is set to a time sufficient for lowering the supplied power Pp from the power value P1 to the power value P2.

B-4. Advantage

In the projector 1000 according to this embodiment, 200 W (rated power mode) or 160 W (power save mode) can be selected as the driving power of the discharge lamp 500. In the projector 1000 according to this embodiment, the duty ratio modulation pattern of the AC pulse current for driving the discharge lamp is changed on the basis of the driving power of the discharge lamp 500. In the power save mode, the differences between the maximum value and the minimum value of the duty ratio and the reference duty ratio are set to be greater than those in the rated power mode.

Accordingly, when the discharge lamp 500 is driven in the power save mode and the lighting circuit controller 812 starts the duty ratio modulation control in the second modulation pattern before the supplied power Pp is equal to the power value P2 (for example, in period C), the excessive melting may occur in the positive electrode. When the excessive melting occurs in the positive electrode, as shown in the comparative example of the first embodiment, the arc length is shortened (FIG. 16B) and the utilization efficiency of light is lowered. Accordingly, the brightness of the image projected by the projector 1000 is lowered or a flickering may occur in the image projected by the projector due to the movement of the arc start point (FIG. 16C).

On the contrary, in the projector according to this embodiment, when the discharge lamp 500 is driven in the power save mode, the lighting circuit controller 812 starts the duty ratio modulation control after the supplied power Pp is equal to the power value P2 on the basis of the detected value of the supplied power Pp input from the lighting circuit 220. That is, since the start time of the duty ratio modulation control is changed on the basis of the driving power of the discharge lamp 500, the temperature of the electrode can be changed in the temperature range in which the utilization efficiency of light is maintained in a good state without depending on the driving power of the discharge lamp 500, thereby stopping the excessive melting of the electrode. As a result, it is possible to elongate the lifetime of the discharge lamp.

C. Third Embodiment

A third embodiment will now be described. The projector according to the third embodiment is different from that of the first embodiment, in that the lighting circuit controller 812 does not control the lighting circuit 220 to modulate the duty ratio, but controls the lighting circuit 220 to change the difference in absolute value between the current in the positive-electrode period of the AC pulse current (hereinafter, also referred to supplied current Ip) supplied to the discharge lamp 500 and the current in the negative-electrode period. In this embodiment, the control for changing the difference in absolute value between the current in the positive-electrode period of the supplied current Ip and the current in the negative-electrode period is called "current modulation control". In this embodiment, when the discharge lamp 500 is supplied with the AC pulse current, the period of time in which one electrode operates as the positive electrode in one period of the AC pulse current is called the "positive-electrode period" and the period of time in which the electrode operates as the negative electrode is called the "negative-electrode period". The configuration of the projector according to this embodiment is the same as the first embodiment and thus the description of the configuration is omitted.

Figure 20:
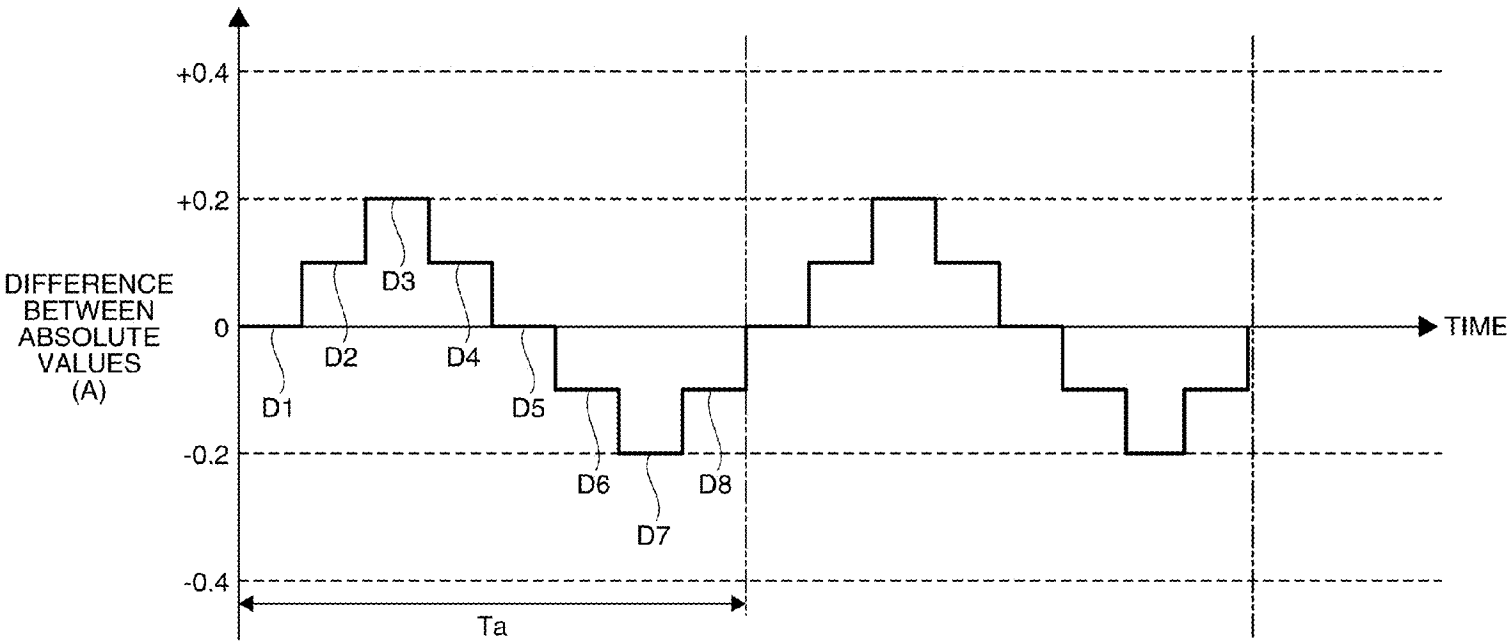
FIG. 20 is a diagram illustrating an example of a current modulation pattern in which the difference in absolute value between the current of the AC pulse current supplied to the discharge lamp in a positive-electrode period and the current in a negative-electrode period is changed.

FIG. 20 shows an example of the current modulation pattern in which the difference in absolute value between the current in the positive-electrode period of the AC pulse current supplied to the discharge lamp 500 and the current in the negative-electrode period is changed. Here, the horizontal axis represents the time and the vertical axis represents the difference in absolute value between the current in the positive-electrode period of the supplied current Ip and the current in the negative-electrode period.

As shown in the drawing, when the modulation period in the current modulation pattern is Ta, the difference in absolute value between the current in the positive-electrode period of the supplied current Ip and the current in the negative-electrode period is changed in steps by 0.1 A every ⅛th of the modulation period Ta. Hereinafter, the time corresponding to each ⅛th of the modulation period Ta is called the "sub period". Each of the sub periods D1 to D8 is a period in which the difference in absolute value between the current in the positive-electrode period of the supplied current Ip and the current in the negative-electrode period is kept constant. In this embodiment, the length of each sub period in the current modulation pattern is set to 8 seconds.

Specifically, when the modulation period in the current modulation pattern is Ta, the difference in absolute value between the current in the positive-electrode period of the supplied current Ip and the current in the negative-electrode period is set to 0 A in the sub period D1, the difference in absolute value between the current in the positive-electrode period and the current in the negative-electrode period increases thereafter by 0.1 A, and the difference in absolute value between the current in the positive-electrode period and the current in the negative-electrode period is set to +0.2 A which is the maximum value in the sub period D3.

Thereafter, the difference in absolute value between the current in the positive-electrode period and the current in the negative-electrode period decreases by 0.1 A and the difference in absolute value between the current in the positive-electrode period of the supplied current Ip and the current in the negative-electrode period is set to −0.2 A which is the minimum in the sub period D7. Thereafter, the difference in absolute value between the current in the positive-electrode period and the current in the negative-electrode period increases by 0.1 A and the increase and decrease of the difference in absolute value between the current in the positive-electrode period of the supplied current Ip and the current in the negative-electrode period is repeated with the period Ta. That is, in this embodiment, the absolute values of the maximum value and the minimum value of the differences in absolute value between the current in the positive-electrode period and the current in the negative-electrode period are all set to 0.2 A.

FIGS. 21A to 21E are diagrams illustrating an example of a waveform of the AC pulse current (supplied current Ip) in this embodiment. In FIGS. 21A to 21E, the DC current Id input to the AC conversion circuit (not shown) of the inverter 222 is shown along with the waveform of the supplied current Ip. In the drawing, the horizontal axis represents the time and the vertical axis represents the current value. Times t1, t2, and t3 represent the polarity inverting times of the AC pulse current supplied to the discharge lamp. In FIGS. 21A to 21E, the electrode 610 operates as the positive electrode when the supplied current Ip has a positive value, and the electrode 610 operates as the negative electrode when the supplied current Ip has a negative value. In FIGS. 21A to 21E, the positive-electrode period is denoted by Tp and the negative-electrode period is denoted by Tn. The sum of the positive-electrode period Tp and the negative-electrode period Tn is equal to one period of the supplied current Ip. Here, the duty ratio of the supplied current Ip is the ratio of the positive-electrode period Tp occupied in one period of the supplied current Ip. In the examples shown in FIGS. 21A to 21E, the duty ratios are all set to 50%.

Figure 21A:
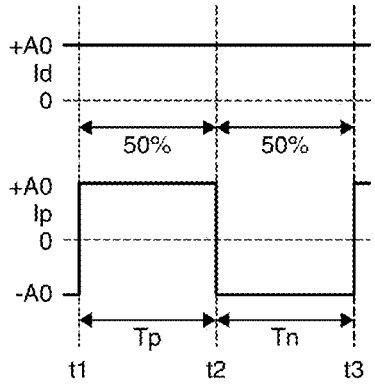
FIGS. 21A to 21E are diagrams illustrating examples of the waveform of the AC pulse current.

FIG. 21A shows the waveform of the supplied current Ip when the difference in absolute value between the current in the positive-electrode period Tp of the supplied current Ip and the current in the negative-electrode period Tn is 0 A. In the example shown in FIG. 21A, the lighting circuit controller 812 carries out the control to set the DC current Id to the same current value (+A0) in each of the positive-electrode period Tp and the negative-electrode period Tn. As a result, the supplied current Ip has a current value +A0 in the positive-electrode period Tp and has a current value −A0 in the negative-electrode period Tn. That is, the difference in absolute value between the current in the positive-electrode period of the supplied current Ip and the current in the negative-electrode period is 0 A.

Figure 21D:
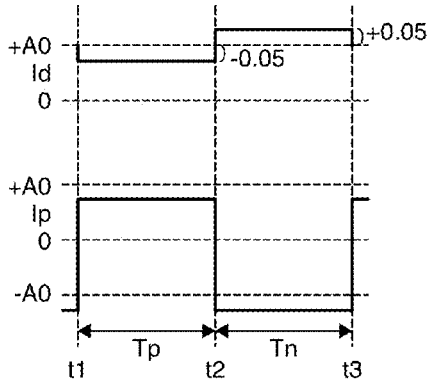
Figure 21B:
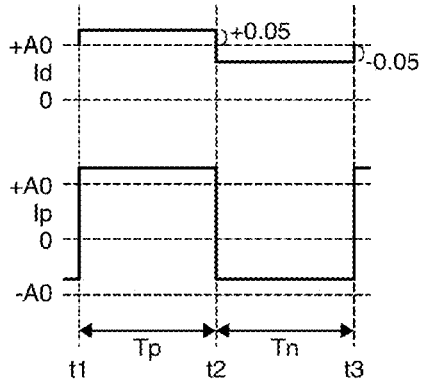

In the example shown in FIG. 21B, the lighting circuit controller 812 carries out the control to set the current value of the DC current Id to +A0+0.05 A in the positive-electrode period Tp and to set the current value of the DC current Id to +A0−0.05 A in the negative-electrode period Tn. As a result, the supplied current Ip has a current value of +A0+0.05 A in the positive-electrode period Tp and has a current value of −A0+0.05 A in the negative-electrode period Tn. The difference in absolute value between the current in the positive-electrode period of the supplied current Ip and the current in the negative-electrode period is +0.1 A.

Figure 21E:
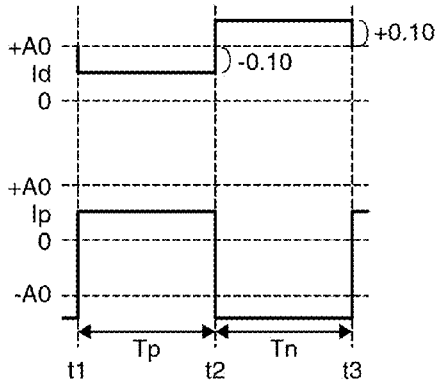
Figure 21C:
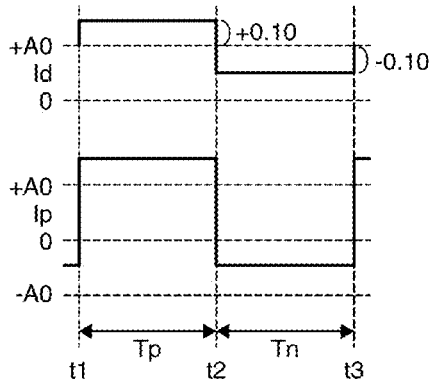

Similarly, the difference in absolute value between the current in the positive-electrode period of the supplied current Ip and the current in the negative-electrode period is +0.2 A in the example shown in FIG. 21C, the difference in absolute value between the current in the positive-electrode period of the supplied current Ip and the current in the negative-electrode period is −0.1 A in the example shown in FIG. 21D, and the difference in absolute value between the current in the positive-electrode period of the supplied current Ip and the current in the negative-electrode period is −0.2 A in the example shown in FIG. 21E. In this embodiment, the "difference in absolute value between the current in the positive-electrode period of the supplied current Ip and the current in the negative-electrode period" means the result obtained by subtracting the absolute value of the current in the negative-electrode period from the current value in the positive-electrode period of the supplied current Ip.

Figure 22A:
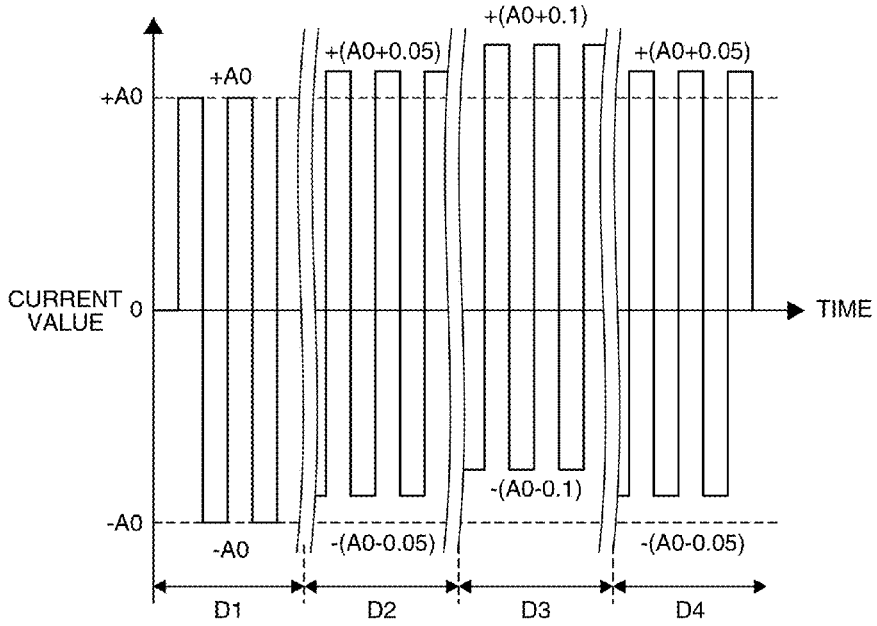
FIGS. 22A and 22B are diagrams illustrating a waveform variation of the supplied current in the current modulation pattern.
Figure 22B:
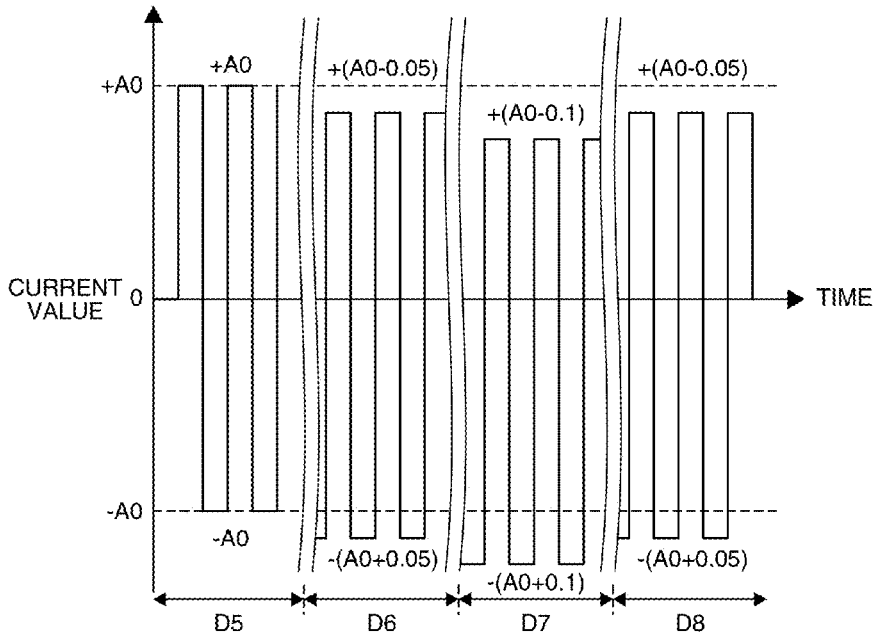

FIGS. 22A and 22B are diagrams illustrating the waveform variation of the supplied current Ip when the difference in absolute value between the current in the positive-electrode period of the supplied current Ip and the current in the negative-electrode period in the current modulation pattern shown in FIG. 20 is changed. Here, the horizontal axis represents the time and the vertical axis represents the current value. FIG. 22A shows the waveform variation of the supplied current Ip from the sub period D1 to the sub period D4 in FIG. 20. In the sub period D1, the current waveform in which the difference in absolute value between the current in the positive-electrode period of the supplied current Ip and the current in the negative-electrode period is 0 A is continued. In the sub period D2, the current waveform is changed to the current waveform in which the difference in absolute value between the current in the positive-electrode period of the supplied current Ip and the current in the negative-electrode period is +0.1 A, which is continued in the sub period D2. In the sub period D3, the current waveform is changed to the current waveform in which the difference in absolute value between the current in the positive-electrode period of the supplied current Ip and the current in the negative-electrode period is +0.2 A, which is continued in the sub period D3. In the sub period D4, the current waveform is changed to the current waveform in which the difference in absolute value between the current in the positive-electrode period of the supplied current Ip and the current in the negative-electrode period is +0.1 A, which is continued in the sub period D4.

FIG. 22B shows the waveform variation of the supplied current Ip from the sub period D5 to the sub period D8 in FIG. 20. In the sub period D5, the current waveform in which the difference in absolute value between the current in the positive-electrode period of the supplied current Ip and the current in the negative-electrode period is 0 A is continued. In the sub period D6, the current waveform is changed to the current waveform in which the difference in absolute value between the current in the positive-electrode period of the supplied current Ip and the current in the negative-electrode period is −0.1 A, which is continued in the sub period D6. In the sub period D7, the current waveform is changed to the current waveform in which the difference in absolute value between the current in the positive-electrode period of the supplied current Ip and the current in the negative-electrode period is −0.2 A, which is continued in the sub period D7. In the sub period D8, the current waveform is changed to the current waveform in which the difference in absolute value between the current in the positive-electrode period of the supplied current Ip and the current in the negative-electrode period is −0.1 A, which is continued in the sub period D8.

In this way, when the difference in current value between the positive-electrode period and the negative-electrode period is changed with the constant duty ratio, it is possible to easily change the ratio of the power supplied to one electrode in the positive-electrode period and the power supplied thereto in the negative-electrode period. Therefore, it is possible to suppress the formation of the steady convection in the discharge lamp 500 by changing the temperature distribution in both electrodes 610 and 710 with the passing of time. As a result, it is possible to prevent the partial consumption of the electrodes 610 and 710 and the partial education of the electrode material.

D. Modified Example

Figure 23:
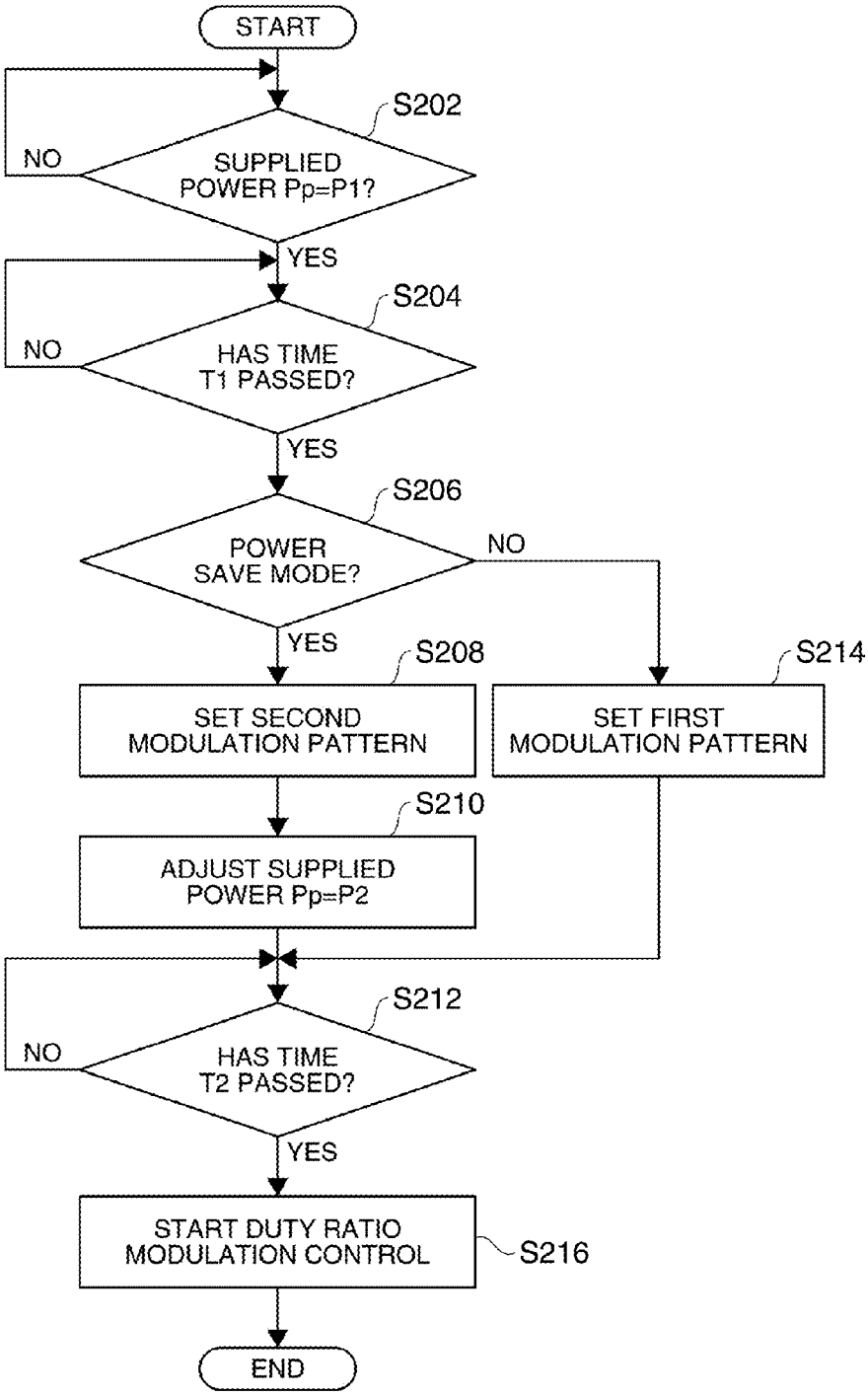
FIG. 23 is a flowchart illustrating a modified example of the duty ratio modulation control starting process.

FIG. 23 is a flowchart illustrating a process of starting the duty ratio modulation control according to a modification to the second embodiment. As shown in the drawing, in this modified example, when it is determined in step S206 that the driving mode is the power save mode and when it is determined that the driving mode is not the power save mode (that is, the driving mode is the rated power mode), the lighting circuit controller 812 waits for the passing of the time T2 and then starts the duty ratio modulation control in step S212. Here, in step S212, it is additionally determined whether the time T2 has passed again in the time T1 after the supplied current IP is equal to the power value P1.

That is, in this modified example, when the rated power mode is selected as the driving mode of the discharge lamp 500 and when the power save mode is selected, the duty ratio modulation control is started in the same time after starting the driving of the discharge lamp 500. For example, as shown in FIG. 18 of the second embodiment, when the time T2 is set to be equal to the time of period C, the duty ratio modulation control is started in period D regardless of the driving mode of the discharge lamp 500. The time T2 may not be equal to the time of period C and may be set to any value as long as it is sufficient time for lowering the supplied power Pp from the power P1 to the power value P2. For example, the duty ratio modulation control may be started in a predetermined time after period D is started. In this case, it is also possible to suppress the excessive melting of the electrodes.

In the above-mentioned embodiments, the duty ratio modulation pattern is exemplified, but the duty ratio modulation pattern is not limited to the above-mentioned embodiments. The duty ratio modulation pattern can be determined so that the electrode temperature is changed in a proper range in the state where the applied voltage Vp and the supplied current Ip are stabilized.

In the first embodiment, the lighting circuit controller 812 does not carry out the duty ratio modulation control but carries out the control with a constant duty ratio (50%) until the time T1 has passed after the supplied power Pp is equal to the power value P1. However, before the time T1 passes after the supplied power Pp is equal to the power value P1, the duty ratio modulation control may be carried out using a modulation pattern in which the maximum value of the duty ratio is smaller than that of the first modulation pattern. In the first modulation pattern of the first embodiment, the reference duty ratio is 50%, the maximum duty ratio is 60%, and the minimum duty ratio is 40%. However, for example, the maximum duty ratio may be 55% and the minimum duty ratio may be 45%. In this way, when the duty ratio modulation control is started using a modulation pattern in which the maximum value of the duty ratio is smaller than that of the duty ratio modulation pattern (for example, the first modulation pattern) for changing the electrode temperature within an appropriate range in a state where the applied voltage Vp and the supplied current Ip are stabilized before the applied voltage Vp and the supplied current Ip are stabilized, it is possible to suppress the excessive melting of the electrodes, compared with the case where the duty ratio modulation control is started using the first modulation pattern before the applied voltage Vp and the supplied current Ip are stabilized.

In the above-mentioned embodiments, the liquid crystal light valves 330R, 330G, and 330B may be used as the light modulating unit of the projector 1000 (FIG. 1), but other modulation unit such as a DMD (Digital Micro Mirror Device which is a trademark of Texas Instruments Incorporated) may be used as the light modulating unit. The disclosure may be applied to various image displaying apparatuses such as liquid crystal display devices, exposure devices, and illumination devices, as long as they includes a discharge lamp as a light source.

Figure 24:
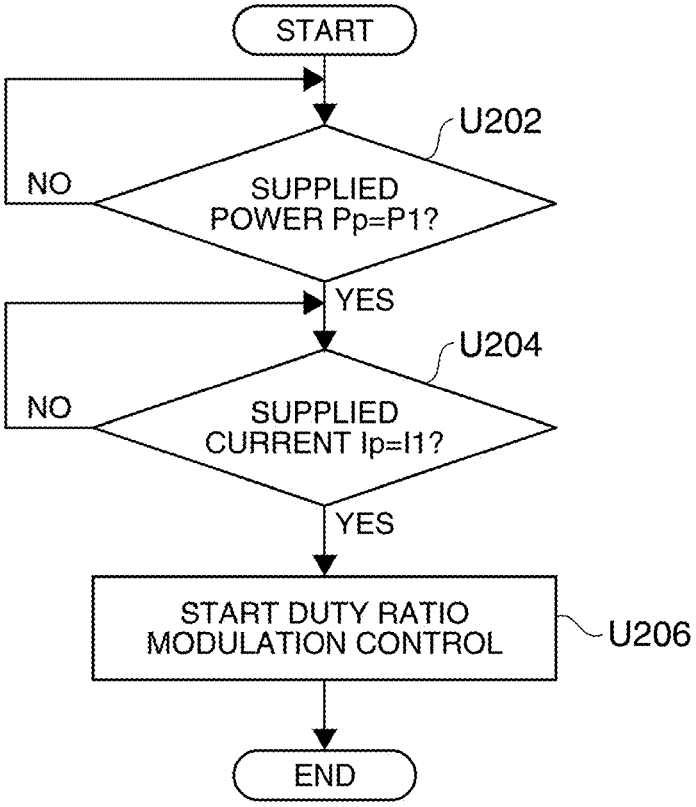
FIG. 24 is a flowchart illustrating the flow of the duty ratio modulation control starting process in the modified example.
Figure 25:
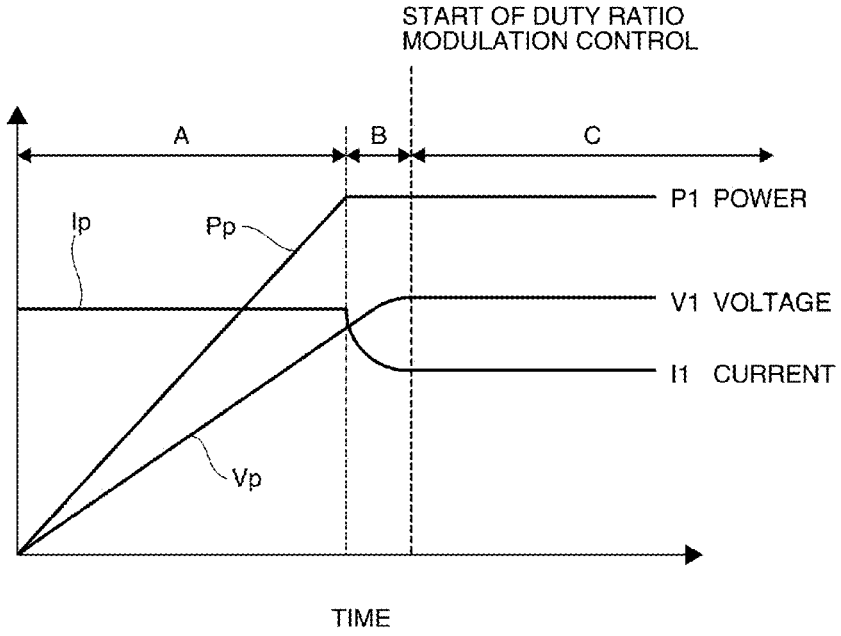
FIG. 25 is a diagram illustrating a start time of the duty ratio modulation control in the modified example.

In the first embodiment, when the time T1 has passed after the supplied power Pp is raised to Pp=P1, the duty ratio modulation control is started. However, the start time of the duty ratio modulation control is not limited to the determination based on the time, but may be determined on the basis of the supplied current Ip or the applied voltage Vp. For example, an example where the duty ratio modulation control is started on the basis of the supplied current Ip will be described with reference to FIGS. 24 and 25. FIG. 24 is a flowchart illustrating the flow of the process of starting the duty ratio modulation control according to a modified example. FIG. 25 is a diagram illustrating the start time of the duty ratio modulation control in the modified example along with the temporal variations in supplied power, applied voltage, and supplied current after starting up the discharge lamp.

In the discharge lamp driving device according to the modified example, similarly to the first embodiment, when the discharge lamp 500 is started up, the lighting circuit controller 812 determines whether the supplied power Pp is equal to P1 (step U202), as shown in FIG. 24. When it is determined that the supplied power Pp is equal to P1 (YES in step U202), the lighting circuit controller 812 acquires the detected value of the supplied current Ip from the lighting circuit 220 and determines whether the supplied current Ip is equal to I1 (step U204). When it is determined that the supplied current Ip is not equal to I1 (NO in step U204), the lighting circuit controller 812 performs the process of step U204 again. That is, the lighting circuit controller 812 repeatedly performs the process of step U204 until the supplied current Ip is equal to I1. When it is determined that the supplied current Ip is equal to I1 (YES in step U204), the lighting circuit controller 812 starts the duty ratio modulation control using the first modulation pattern (step U206).

In the discharge lamp driving device according to the modified example, as shown in FIG. 25, when the supplied current Ip is equal to the current value I1, the duty ratio modulation control is started (period C). In this case, it is also possible to suppress the excessive melting of the electrodes, thereby elongating the lifetime of the discharge lamp. Period B in the modified example corresponds to the "wait period" in the claims.

Although various embodiments have been described, the disclosure is not limited to these embodiments, but may be modified in various forms without departing from the spirit and scope of the disclosure. For example, the functions embodied by hardware may be embodied by software by allowing the CPU to execute a predetermined program. Therefore, it is manifestly intended that embodiments in accordance with the present disclosure be limited only by the claims and the equivalents thereof.

What is claimed is:

1. A discharge lamp driving device comprising:

a discharge lamp lighting unit configured to supply power to a discharge lamp while alternately switching a polarity of a voltage applied across two electrodes of the discharge lamp; and a controller that performs a modulation control of the power in accordance with a power ratio characterized by the power supplied in a polarity switching period, the polarity switching period being two temporally adjacent periods consisting of a positive-electrode period in which one of the electrodes operates as a positive electrode and a negative-electrode period in which the one of the electrodes operates as a negative electrode, the controller starting the modulation control at a predetermined time after the power supplied to the discharge lamp reaches a predetermined power value.

2. The discharge lamp driving device according to claim 1, wherein the power ratio is further defined by a ratio of a time of the positive-electrode period and a time of the polarity switching period.

3. The discharge lamp driving device according to claim 1, wherein the power ratio is further defined by a ratio of a time of the positive-electrode period and a time of the polarity switching period for an AC current supplied to the discharge lamp.

4. The discharge lamp driving device according to claim 1, wherein the power ratio is further defined by a difference in absolute value between a current supplied in the positive-electrode period and a current supplied in the negative-electrode period in the polarity switching period.

5. The discharge lamp driving device according to claim 1, the power ratio further including a first power ratio and a second power ratio, wherein the controller performs the modulation control in accordance with the first power ratio after the power supplied to the discharge lamp reaches the predetermined power value, and then the modulation is performed in accordance with the second power ratio, and wherein a maximum value of the first power ratio is smaller than a maximum value of the second power ratio.

6. The discharge lamp driving device according to claim 1, wherein the predetermined time is based on at least one of a value of the voltage applied across the two electrodes and a value of a current supplied to the discharge lamp.

7. The discharge lamp driving device according to claim 1, wherein the predetermined time is sufficiently long enough to provide for the stabilization of the voltage applied across the two electrodes and a current supplied to the discharge lamp.

8. The discharge lamp driving device according to claim 1, further comprising a second power value lower than the predetermined power value, and wherein upon receiving a power control instruction from a user, and only after the power has first stabilized at the predetermined power level, the controller performs a control that the power to the discharge lamp is lowered to the second power value.

9. The discharge lamp driving device according to claim 1, wherein the power ratio changes based upon whether the discharge lamp driving device is operating under a rated power mode or a power save mode.

10. The discharge lamp driving device according to claim 1, wherein the power ratio is based on a duty ratio of an AC current.

11. The discharge lamp driving device according to claim 1, wherein the power ratio is based on a difference of an AC current in the positive-electrode period and the negative-electrode period.

12. A discharge lamp driving device comprising:

a discharge lamp lighting unit configured to supply power to a discharge lamp while alternately switching a polarity of a voltage applied across two electrodes of the discharge lamp; and a controller that performs a modulation control of the power in accordance with a power ratio characterized by the power supplied in a polarity switching period, the polarity switching period being two temporally adjacent periods consisting of a positive-electrode period in which one of the electrodes operates as a positive electrode and a negative-electrode period in which the one of the electrodes operates as a negative electrode, the controller starting the modulation control after a wait time measured from the power supplied to the discharge lamp reaching a predetermined value, the wait time being determined based on an electrical behavior of the discharge lamp.

13. The discharge lamp driving device according to claim 12, wherein the wait time is equal to a period of time for a current supplied to the discharge lamp to be lowered to a predetermined current value.

14. The discharge lamp driving device according to claim 12, wherein the wait time is equal to a period of time for the voltage applied to the discharge lamp to be raised to a predetermined voltage value.

15. A light source device comprising:

a discharge lamp;

a discharge lamp lighting unit configured to supply power to the discharge lamp while alternately switching a polarity of a voltage applied across two electrodes of the discharge lamp; and a controller that performs a modulation control of the power in accordance with a power ratio characterized by the power supplied in a polarity switching period, the polarity switching period being two temporally adjacent periods consisting of a positive-electrode period in which one of the electrodes operates as a positive electrode and a negative-electrode period in which the one of the electrodes operates as a negative electrode, the controller starting the modulation control at a predetermined time after the power supplied to the discharge lamp reaches a predetermined power value.

16. An image display apparatus comprising:

a discharge lamp which is a light source for displaying an image, the discharge lamp having two electrodes; and a controller that performs a modulation control of a power supplied to the discharge lamp in accordance with a power ratio characterized by the power supplied in a polarity switching period, the polarity switching period being two temporally adjacent periods consisting of a positive-electrode period in which one of the electrodes operates as a positive electrode and a negative-electrode period in which the one of the electrodes operates as a negative electrode, the controller starting the modulation control at a predetermined time after the power supplied to the discharge lamp reaches a predetermined power value.

17. A discharge lamp driving method for supplying power to a discharge lamp having two electrodes comprising:

alternately switching a polarity of a voltage applied across the two electrodes of the discharge lamp;

performing a modulation control of the power in accordance with a power ratio characterized by the power supplied in a polarity switching period, the polarity switching period being two temporally adjacent periods consisting of a positive-electrode period in which one of the electrodes operates as a positive electrode and a negative-electrode period in which the one of the electrodes operates as a negative electrode; and starting the modulation control at a predetermined time after the power supplied to the discharge lamp reaches a predetermined power value.

18. A discharge lamp driving method for supplying power to a discharge lamp having two electrodes comprising:

alternately switching a polarity of a voltage applied across the two electrodes of the discharge lamp;

performing a modulation control of the power in accordance with a power ratio characterized by the power supplied in a polarity switching period, the polarity switching period being two temporally adjacent periods consisting of a positive-electrode period in which one of the electrodes operates as a positive electrode and a negative-electrode period in which the one of the electrodes operates as a negative electrode; and starting the modulation control after a wait time measured from the power supplied to the discharge lamp reaching a predetermined value, the wait time being determined based on an electrical behavior of the discharge lamp.

* * * * *